US009902151B2

(12) United States Patent
Mizukami

(10) Patent No.: US 9,902,151 B2
(45) Date of Patent: Feb. 27, 2018

(54) LIQUID EJECTION HEAD, LIQUID EJECTION UNIT, AND LIQUID EJECTION DEVICE

(71) Applicant: Satoshi Mizukami, Kanagawa (JP)

(72) Inventor: Satoshi Mizukami, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/064,018

(22) Filed: Mar. 8, 2016

(65) Prior Publication Data

US 2016/0263892 A1 Sep. 15, 2016

(30) Foreign Application Priority Data

Mar. 11, 2015 (JP) ..... 2015-048225
Dec. 14, 2015 (JP) ..... 2015-243062

(51) Int. Cl.
*B41J 2/14* (2006.01)

(52) U.S. Cl.
CPC ..... *B41J 2/14233* (2013.01); *B41J 2202/11* (2013.01)

(58) Field of Classification Search
CPC ..... B41J 2/14201; B41J 2/14233; B41J 2/14274; B41J 2/161; B41J 2/1612
See application file for complete search history.

(56) References Cited

U.S. PATENT DOCUMENTS 6,350,019 B1 2/2002 Shingai et al.
6,361,154 B1 3/2002 Watanabe et al.
6,447,106 B1 * 9/2002 Watanabe ..... B41J 2/14233 347/70
7,575,306 B2 8/2009 Kodama
7,708,389 B2 5/2010 Murai
8,969,105 B2 3/2015 Hoisington et al.
(Continued)

FOREIGN PATENT DOCUMENTS

JP 2001-26106 1/2001
JP 2001026106 A * 1/2001 ..... B41J 2/14233
(Continued)

OTHER PUBLICATIONS

Aoyama, MachineTranslationofJP2014-151511A, 2014.*
Aoyama, MachinteTranslationofJP2014-151511A, 2014.*
Shinkai, MachineTranslationofJP2001026106, 2001.*

*Primary Examiner* — Geoffrey Mruk
*Assistant Examiner* — Scott A Richmond
(74) *Attorney, Agent, or Firm* — Cooper & Dunham LLP

(57) ABSTRACT

A liquid ejection head includes a plurality of structures arrayed in a predetermined direction, each structure including a nozzle to eject liquid, a pressure chamber in communication with the nozzle, and an ejection drive unit to increase pressure of the liquid in the pressure chamber. The ejection drive unit of each structure includes a diaphragm to form a wall of the pressure chamber, and an electromechanical transducer element including an electromechanical transducer film, the diaphragm being convex toward the pressure chamber. When an amount of curvature of the diaphragm for the pressure chamber of each structure is defined by a radius of curvature, an inclination difference of the radius of curvature with respect to the predetermined direction is equal to or less than 2500 μm.

12 Claims, 15 Drawing Sheets

(56) References Cited

U.S. PATENT DOCUMENTS

| | | | | |
|---|---|---|---|---|
| 9,168,744 | B2 | 10/2015 | Mizukami et al. | |
| 9,186,894 | B2 | 11/2015 | Mizukami et al. | |
| 2005/0219328 | A1 | 10/2005 | Kodama | |
| 2006/0193233 | A1 | 8/2006 | Fujimori et al. | |
| 2009/0115821 | A1* | 5/2009 | Tsukamoto | B41J 2/04581 347/68 |
| 2009/0273652 | A1 | 11/2009 | Kazama et al. | |
| 2011/0063348 | A1 | 3/2011 | Mita | |
| 2015/0057540 | A1 | 2/2015 | Sameshima et al. | |
| 2015/0349240 | A1 | 12/2015 | Mizukami | |
| 2016/0263893 | A1 | 9/2016 | Mizukami et al. | |

FOREIGN PATENT DOCUMENTS

| | | | | |
|---|---|---|---|---|
| JP | 3555682 | | 8/2004 | |
| JP | 3956950 | | 8/2007 | |
| JP | 4283948 | | 3/2009 | |
| JP | 4283948 | | 6/2009 | |
| JP | 2009-178982 | | 8/2009 | |
| JP | 2012-158011 | | 8/2012 | |
| JP | 5244749 | | 7/2013 | |
| JP | 2013-538446 | | 10/2013 | |
| JP | 2014-151511 | | 8/2014 | |
| JP | 2014151511 | A * | 8/2014 | |
| WO | WO 2006078041 | A1 * | 7/2006 | B41J 2/161 |

* cited by examiner

LIQUID EJECTION HEAD, LIQUID EJECTION UNIT, AND LIQUID EJECTION DEVICE

CROSS-REFERENCE TO RELATED APPLICATION

The present application is based upon and claims the benefit of priority of Japanese Patent Application No. 2015-048225, filed on Mar. 11, 2015, and Japanese Patent Application No. 2015-243062, filed on Dec. 14, 2015, the contents of which are incorporated herein by reference in their entirety.

BACKGROUND OF THE INVENTION

1. Field of the Invention

The present invention relates to a liquid ejection head, a liquid ejection unit, and a liquid ejection device.

2. Description of the Related Art

A liquid ejection head for use in an image recording apparatus or image forming apparatus, such as a printer, a facsimile machine, or a copier, is known, which includes a nozzle to eject ink droplets, a pressure chamber in communication with the nozzle, and an electromechanical transducer element, such as a piezoelectric element, to pressurize the ink in the pressure chamber. Further, two types of liquid ejection heads are put in practical use, one type using an actuator of longitudinal vibration mode, and the other type using an actuator of flexural vibration mode.

For example, there is known a liquid ejection head of the type using the actuator of flexural vibration mode, which includes a layer of a piezoelectric material uniformly formed on an overall surface of a diaphragm by using a film deposition technique. In this liquid ejection head, an electromechanical transducer element is fabricated by forming the piezoelectric material layer into a shape corresponding to a shape of a pressure chamber by using a lithographic process, so that one electromechanical transducer element is provided independently for one pressure chamber. In this liquid ejection head, the diaphragm is bent in a convex form which projects toward the pressure chamber side, and the diaphragm has an amount of deflection. For example, see Japanese Patent No. 3555682 and Japanese Laid-Open Patent Publication No. 2014-151511.

In the above-described liquid ejection head according to the related art, the amount of deflection of the diaphragm on which a single electromechanical transducer element is mounted is taken into consideration. However, a distribution of the amounts of deflection of the diaphragm on which plural electromechanical transducer elements are mounted is not taken into consideration. Hence, in a case of a liquid ejection head in which plural electromechanical transducer elements are arrayed, it is difficult to obtain stable ink ejection characteristics.

SUMMARY OF THE INVENTION

In one aspect, the present invention provides a liquid ejection head in which plural electromechanical transducer elements are arrayed, which is capable of providing stable liquid ejection characteristics.

In one embodiment, the present invention provides a liquid ejection head including a plurality of structures arrayed in a predetermined direction, each structure including a nozzle to eject liquid, a pressure chamber in communication with the nozzle, and an ejection drive unit to increase pressure of the liquid in the pressure chamber, wherein the ejection drive unit of each structure includes a diaphragm to form a wall of the pressure chamber, and an electromechanical transducer element including an electromechanical transducer film, the diaphragm being convex toward the pressure chamber, and wherein, when an amount of curvature of the diaphragm for the pressure chamber of each structure is defined by a radius of curvature, an inclination difference of the radius of curvature with respect to the predetermined direction is equal to or less than 2500 μm.

The object and advantages of the invention will be implemented and attained by means of the elements and combinations particularly pointed out in the claims. It is to be understood that both the foregoing general description and the following detailed description are exemplary and explanatory and are not restrictive of the invention as claimed.

DETAILED DESCRIPTION OF THE PREFERRED EMBODIMENTS

A description will be given of embodiments with reference to the accompanying drawings.

First Embodiment

Figure 1:
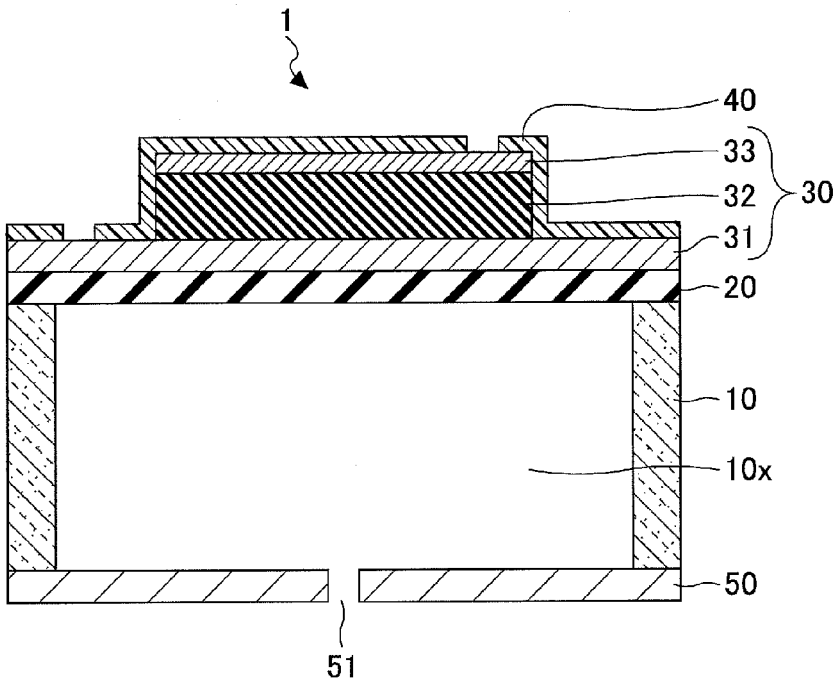
FIG. 1 is a cross-sectional view of a liquid ejection head according to a first embodiment.

FIG. 1 is a cross-sectional view of a liquid ejection head 1 according to a first embodiment. As shown in FIG. 1, the liquid ejection head 1 includes a substrate 10, a diaphragm 20, an electromechanical transducer element 30, and an insulation protective film 40. The electromechanical transducer element 30 includes a lower electrode 31, an electromechanical transducer film 32, and an upper electrode 33.

In the liquid ejection head 1, the diaphragm 20 is formed on the substrate 10, and the lower electrode 31 of the electromechanical transducer element 30 is formed on the diaphragm 20. The electromechanical transducer film 32 is formed in a predetermined region of the lower electrode 31, and the upper electrode 33 is formed on the electromechanical transducer film 32. The electromechanical transducer element 30 is covered by the insulation protective film 40. The insulation protective film 40 includes an opening to which the lower electrode 31 and the upper electrode 33 are selectively exposed, and a wiring from the lower electrode 31 and a wiring from the upper electrode 33 may be routed via the opening.

A nozzle plate 50 including a nozzle 51 to eject ink droplets is bonded to the bottom of the substrate 10. The nozzle plate 50, the substrate 10, and the diaphragm 20 constitute a pressure chamber 10*x* (which may also be called an ink passage, a pressurized liquid chamber, a pressurized chamber, an ejection chamber, or a liquid chamber), and this pressure chamber 10*x* is in communication with the nozzle 51. The diaphragm 20 forms a part of walls of an ink passage (the pressure chamber 10*x*). In other words, the pressure chamber 10*x* may be divided into the substrate 10 (which forms sidewalls of the pressure chamber 10*x*), the nozzle plate 50 (which forms a bottom surface of the pressure chamber 10*x*), and the diaphragm 20 (which forms a top surface of the pressure chamber 10*x*). The pressure chamber 10*x* communicates with the nozzle 51.

Figure 2:
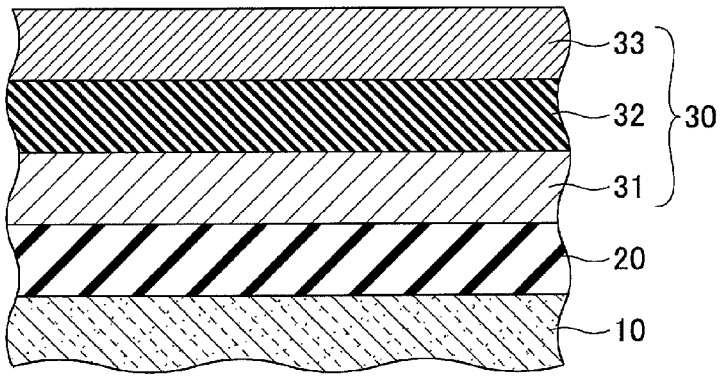
FIG. 2 is a cross-sectional view of a part of the liquid ejection head according to the first embodiment for explaining a manufacturing process.

Next, a method of manufacturing the liquid ejection head 1 is described. As shown in FIG. 2, the diaphragm 20, the lower electrode 31, the electromechanical transducer film 32, and the upper electrode 33 are sequentially laminated on the substrate 10. Subsequently, an etching process is performed on each of the lower electrode 31, the electromechanical transducer film 32, and the upper electrode 33, so that the respective elements 31, 32 and 33 of the electromechanical transducer element 30 have a desired configuration. Subsequently, the electromechanical transducer element 30 is covered by the insulation protective film 40. Then, the opening to which the lower electrode 31 and the upper electrode 33 are selectively exposed is formed in the insulation protective film 40. Subsequently, the substrate 10 is etched from a bottom surface thereof so that the pressure chamber 10*x* is formed. Subsequently, the nozzle plate 50 including the nozzle 51 is bonded to the bottom surface of the substrate 10 so that the liquid ejection head 1 is produced.

Figure 3:
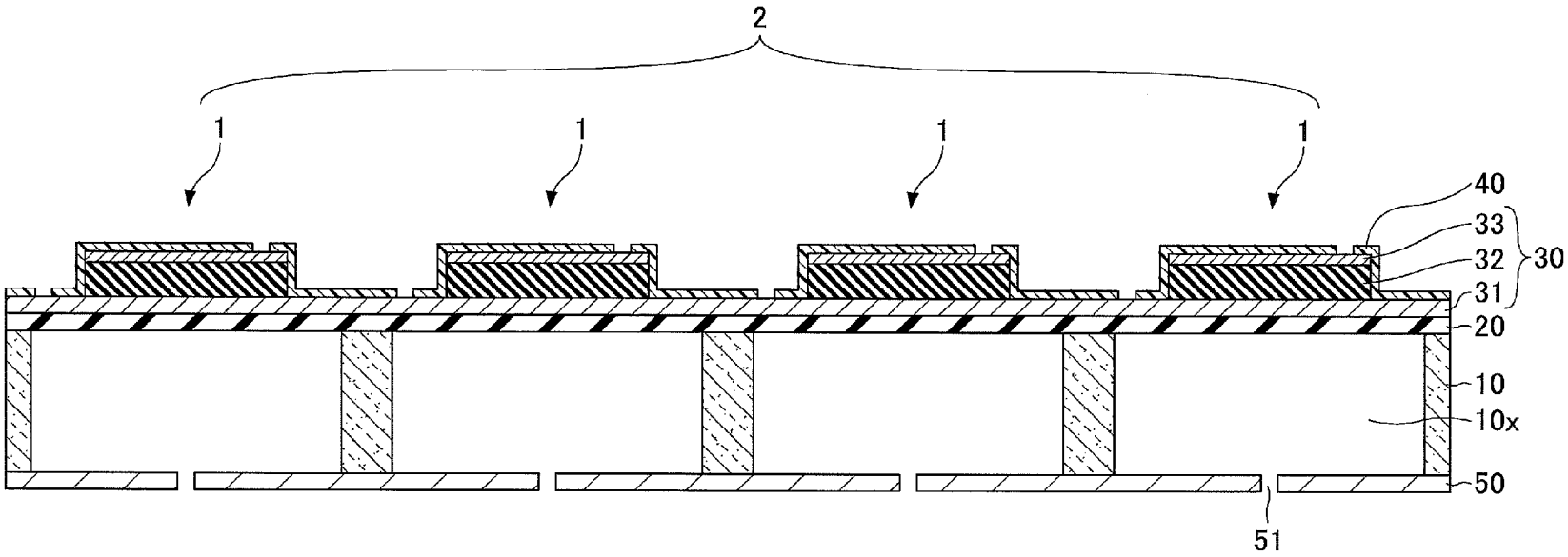
FIG. 3 is a cross-sectional view of the liquid ejection head according to the first embodiment.

Note that only one liquid ejection head 1 is illustrated in FIG. 1. However, in practical applications, a liquid ejection head 2 including a plurality of liquid ejection heads 1 arrayed in a predetermined direction, as shown in FIG. 3, is produced. The liquid ejection head 2 may be a structure including an array of unit structures (the array of liquid ejection heads 1) in the predetermined direction, each unit structure including the nozzle 51 to eject liquid, the pressure chamber 10*x* in communication with the nozzle 51, and an ejection drive unit to increase the pressure of the liquid in the pressure chamber 10*x*. The ejection drive unit may include the diaphragm 20 which forms the top surface of the pressure chamber 10*x*, and the electromechanical transducer element 30 which includes the electromechanical transducer film 32.

Figure 4:
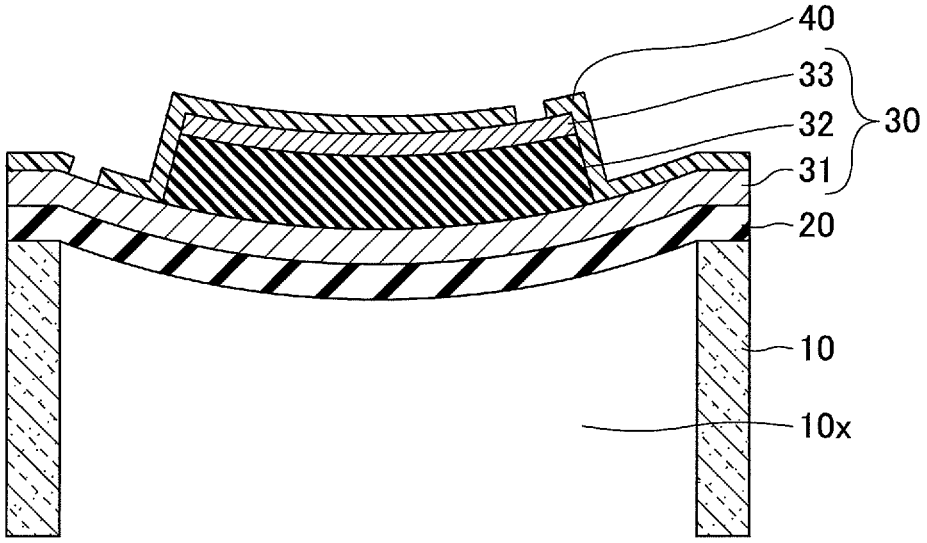
FIG. 4 is a diagram for explaining a curved state of a diaphragm.

In the process of producing the liquid ejection head 2, a curved state of the diaphragm 20 which is projecting toward the side of the pressure chamber 10*x* as shown in FIG. 4 may be present immediately after the pressure chamber 10*x* is formed. Depending on the amount of curvature of the diaphragm 20, the amount of displacement of the diaphragm 20 when ejecting the ink is affected. Further, if the diaphragm 20 is in such a curved state, the residual vibration may occur when ejecting the ink. To prevent the residual vibration, generation of a drive signal having a predetermined waveform is required. However, lowering the frequency of the predetermined waveform is also required to prevent the residual vibration. Hence, it is difficult to provide good liquid ejection performance at high frequencies.

In order to provide good liquid ejection performance at high frequencies, it is necessary to increase the rigidity of the diaphragm 20, the electromechanical transducer film 32, and the insulation protective film 40. The use of a material with a high Young's modulus or an increased thickness of the electromechanical transducer element 30 is required. By taking the stress design of the liquid ejection head 2 into consideration, the diaphragm 20 may be produced to include plural layers which are made of silicon oxide ($SiO_2$), silicon nitride (SiN), polysilicon, etc., as materials.

It is preferred that the diaphragm 20 is formed to have a film thickness in a range between 1 μm and 3 μm. Further, the diaphragm 20 is formed to have a Young's modulus in a range between 75 GPa and 95 GPa, and it is possible to provide good liquid ejection performance at high frequencies.

Figure 5A:
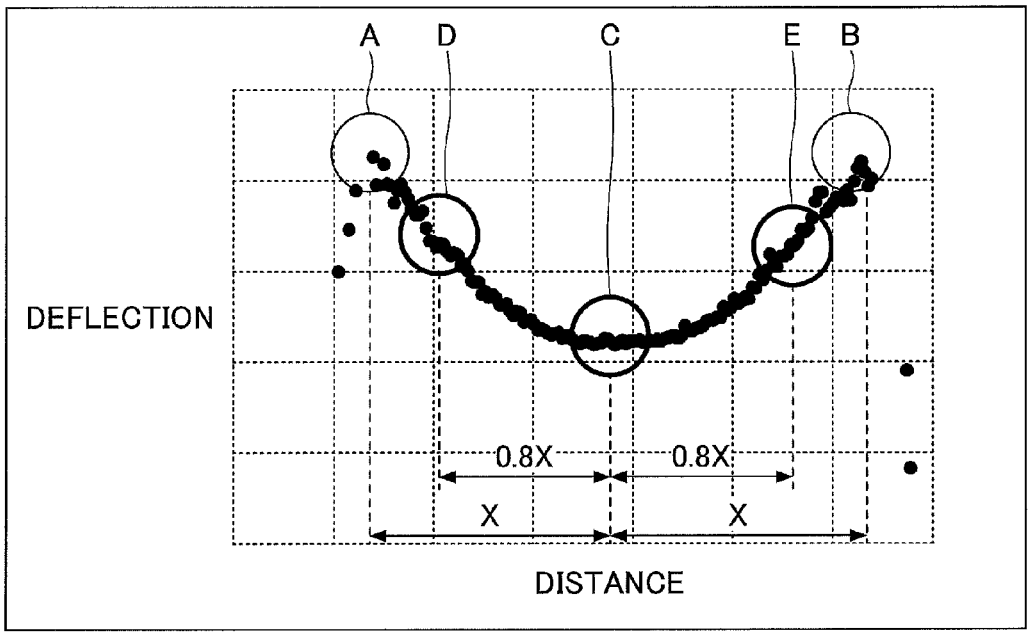
FIG. 5A and FIG. 5B are diagrams for explaining a definition of an amount of curvature of a diaphragm.

Here, the amount of curvature of the diaphragm 20 is described. First, a definition of the amount of curvature of the diaphragm 20 is described with reference to FIG. 5A and FIG. 5B. To compute the amount of curvature of the diaphragm 20, a distribution of deflection amounts of the diaphragm 20 measured from the side of the pressure chamber 10*x*, as shown in FIG. 5A, is acquired using a deflection amount meter ("CCI3000" manufactured by AMETEK).

Figure 5B:
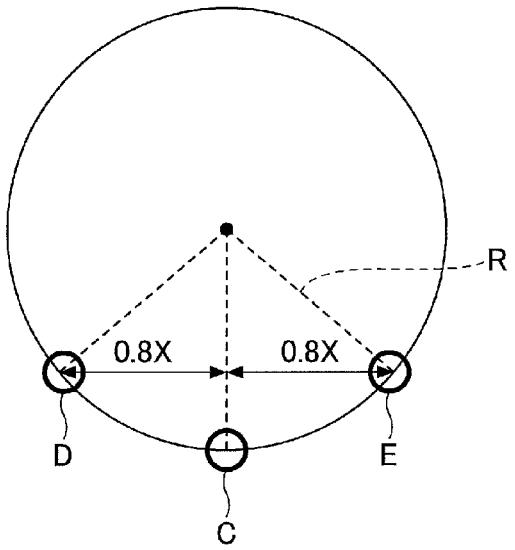

As shown in FIG. 4, a central portion of the diaphragm 20 has a great amount of deflection and end portions of the diaphragm 20 have a small amount of deflection. In the deflection distribution of the diaphragm 20 acquired using the deflection amount meter, as shown in FIG. 5A, a center point C (a center point of deflection) is determined by using points A and B for the end portions of the diaphragm 20 (where the amount of deflection is the minimum) as reference points. A distance between one of the points A and B for the end portions of the diaphragm 20 and the center point C is set to X. Two points D and E lying at a distance of 0.8× from the center point C are determined and, as shown in FIG. 5B, a radius of curvature R of the diaphragm 20 is computed based on the coordinates of the three points including the center point C and the points D and E.

Next, the amount of displacement for the electromechanical transducer element 30 (displacement characteristics) is described. The amount of displacement for the electromechanical transducer element 30 (displacement characteristics) may be considered as one of the characteristics of the electromechanical transducer element 30 affecting the ink ejection quantity and the ejection speed when ejecting the ink. For example, a case in which plural liquid ejection heads 2 are produced from a single wafer is considered and the amounts of displacement for chips in a row lying at an outer peripheral portion of the wafer are compared with the amounts of displacement for chips in a row lying at a central portion of the wafer.

Figure 6A:
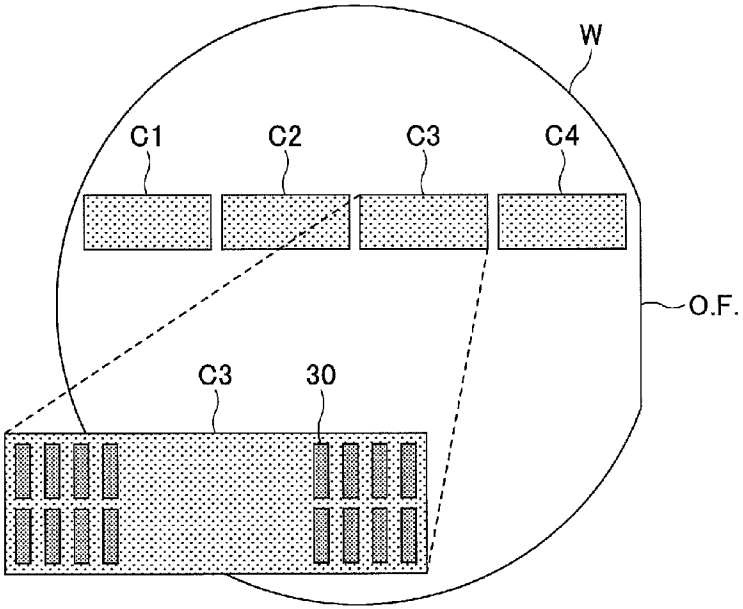
FIG. 6A and FIG. 6B are diagrams for explaining a distribution of amounts of displacement of a diaphragm for chips in a row on a wafer.
Figure 6B:
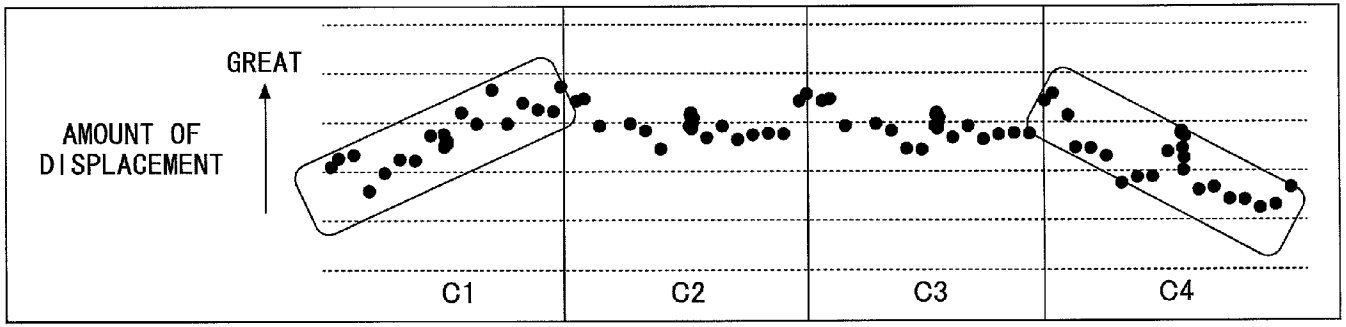

FIG. 6A and FIG. 6B are diagrams for explaining a distribution of amounts of displacement of a diaphragm for chips in a row on a wafer W. FIG. 6A is a plan view of the wafer W in which chips C1 and C4 are arrayed on an outer peripheral portion of the wafer W and chips C2 and C3 are arrayed on a central portion of the wafer W. In each of the chips C1-C4, a plurality of electromechanical transducer elements 30 are arranged. Note that "O.F." indicated in FIG. 6A is an abbreviation for "Orientation Flat".

FIG. 6B shows a distribution of the amounts of displacement of the diaphragm for the electromechanical transducer elements 30 in an array direction (in a direction from the chip C1 to the chip C4) of the electromechanical transducer elements 30 of the chips C1-C4 in a row. As shown in FIG. 6B, in the chips C1-C4, there is a tendency that the amounts of displacement are decreased toward the outer peripheral portion of the wafer W. Namely, there is a tendency that the amounts of displacement for the chips C1 and C4 on the outer peripheral portion of the wafer W are smaller than the amounts of displacement for the chips C2 and C3 on the central portion of the wafer W. The piezoelectric distortion of a piezoelectric material to form the electromechanical transducer film 32, the size of the pressure chamber 10*x*, and the film thicknesses of the component layers may affect the displacement characteristics. It is considered that the results shown in FIG. 6B are derived from the dispersion of film thicknesses or film characteristics on the wafer surface in the direction from the center to the outer periphery of the wafer.

It is found by the consideration of the inventor that the deflection state of the diaphragm 20 shown in FIG. 4 varying from the center to the outer peripheral portion on the wafer surface is a major factor of the distribution of the amounts of displacement (displacement characteristics) of the diaphragm shown in FIG. 6B. Further, it is found that, for the chips C1 and C4 on the outer peripheral portion of the wafer W, the deflection state of the diaphragm 20 varies in the array direction of the electromechanical transducer elements 30 and the deflection state of the diaphragm 20 mostly corresponds to the inclination of the displacement characteristics in the array direction. Namely, it is found that, in order to prevent the inclination of the amounts of displacement for the chips C1 and C4 in the row on the outer peripheral portion of the wafer W, it is necessary to prevent the inclination of the amounts of deflection of the diaphragm 20.

Care should be taken on the case in which a specific dispersion of piezoelectric performance occurs with the distribution of the amounts of displacement for the electromechanical transducer elements 30 of the chips in the row or between the rows as shown in FIG. 6B, not on the case of the random dispersion at the time of ink ejection. This specific dispersion greatly affects the ink ejection quantity and the ejection speed at the time of ink ejection, which may be recognized as a clearly defective item with respect to the quality when the ink is actually printed on paper.

A conceivable method for preventing the outflow of defective heads with liquid ejection performance variations is that when assembling the liquid ejection heads 2 only the chips on the central portion of the wafer are selected. However, this method is not desirable. When the conforming item ratio of the chips on the outer peripheral portion of the wafer is considered, all the electromechanical transducer elements 30 on the outer peripheral portion of the wafer become defective items. In view of the total cost, this may be a major factor of cost increase.

Further, another preventive method is to adjust the voltage waveform at the time of ink ejection with respect to the liquid ejection heads 2 produced from the chips on the outer peripheral portion of the wafer in order to correct the dispersion of the ink ejection quantity or the ejection speed at the time of ink ejection. However, this method is also not desirable. The liquid ejection heads 2 produced from the chips on the central portion of the wafer and having a smaller dispersion coexist. This requires the preparation of plural voltage waveforms for the liquid ejection device including plural liquid ejection heads 2, which may be a major factor of cost increase of the liquid ejection device.

Accordingly, it is preferred to reduce the dispersion of the piezoelectric performance of the electromechanical transducer film 32 in order to prevent the dispersion of the ink ejection quantity and the ejection speed at the time of ink ejection. However, there is not only the case of the random dispersion at the time of ink ejection but also the case in which the specific piezoelectric performance dispersion with the distribution of the amounts of displacement of the diaphragm for the electromechanical transducer elements 30 of the chips in the row or between the rows arrayed in the liquid ejection head 2, and the prevention of such specific piezoelectric performance dispersion must be carried out.

Next, how much the specific dispersion of the piezoelectric performance for the electromechanical transducer elements 30 in the row or between the rows arrayed in the liquid ejection head 2 should be prevented is described.

Figure 7:
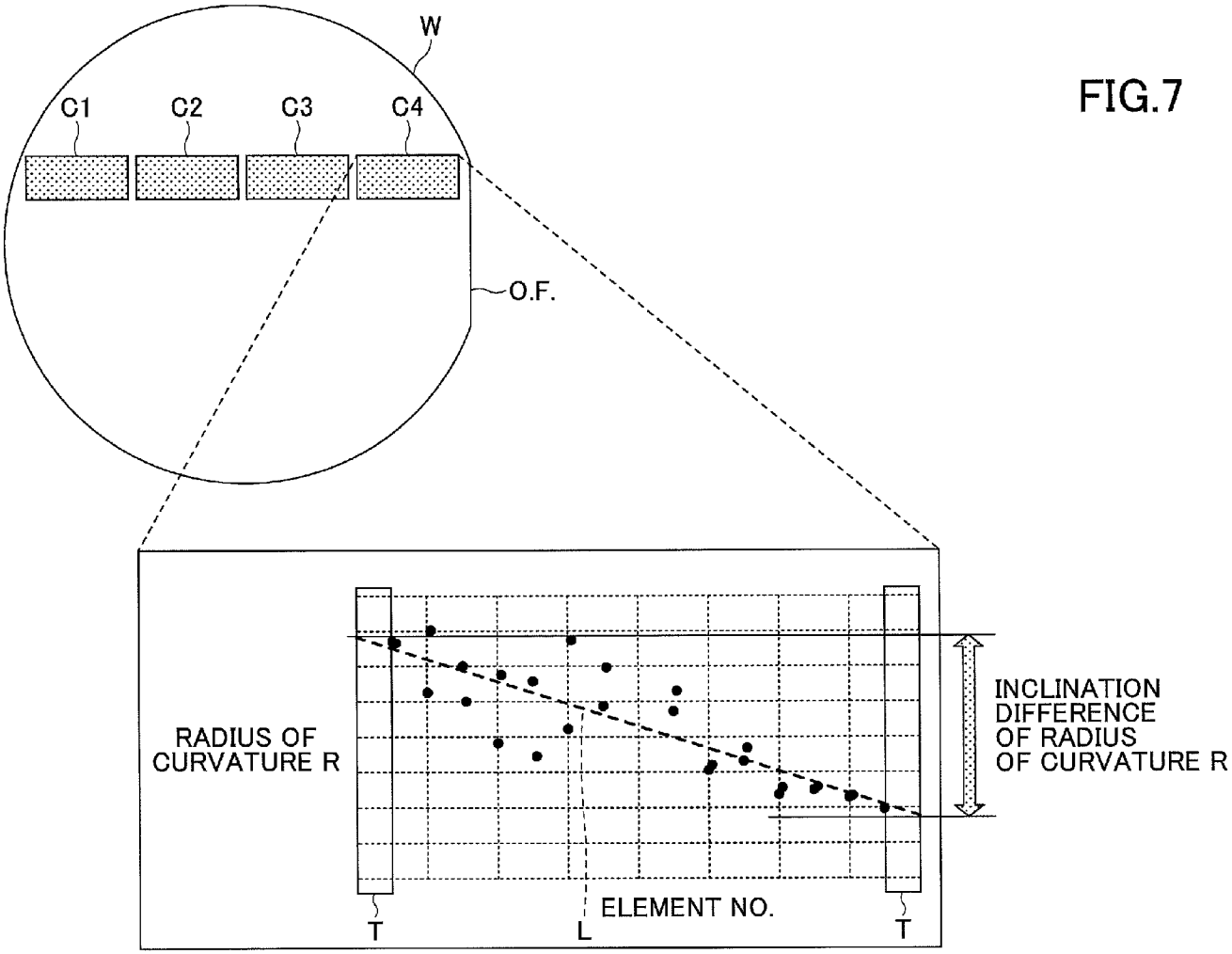
FIG. 7 is a diagram showing a distribution of radii of curvature R of a diaphragm for electromechanical transducer elements of chips in a row on an outer peripheral portion of a wafer.

FIG. 7 is a diagram for explaining a distribution of radii of curvature R of a diaphragm for electromechanical transducer elements of chips in a row on an outer peripheral portion of a wafer. In FIG. 7, the horizontal axis indicates an element number of each of the electromechanical transducer elements 30 arrayed, and the vertical axis indicates a radius of curvature R of the diaphragm 20. In FIG. 7, "T" indicates a region of the chip C4 where twenty (20) channels of electromechanical transducer elements 30 are arrayed in the array direction from an end electromechanical transducer element 30 at one end of the chip C4 in the array direction. In the following, the 20 channels of electromechanical transducer elements 30 are referred to as the electromechanical transducer elements 30.

As indicated by the bold-face dotted line in FIG. 7, an approximated straight line "L" is drawn by excluding the 20 channels of electromechanical transducer elements 30 arrayed from each of the ends of the chip C4. The distribution of the radii of curvature R in the regions in the vicinity of each of the ends of the chip C4 differs greatly, and these 20 channels of electromechanical transducer elements 30 are excluded. Note that the reason why the distribution of the radii of curvature R in the region in the vicinity of each of the ends of the chip C4 differs greatly is not sufficiently elucidated.

There may be a case in which some dummy channels which do not eject ink droplets are disposed at each of the ends of the nozzle row. When the dummy channels are disposed, the 20 channels of electromechanical transducer elements 30 from each of the ends of the chip are selected from among the normal channels which eject ink droplets by excluding the dummy channels which do not eject ink droplets.

As shown in FIG. 7, a difference between the maximum radius of curvature and the minimum radius of the diaphragm 20 for the electromechanical transducer elements 30, corresponding to the radii of curvature at the left and right ends of the approximated straight line L, is defined as an inclination difference of the radius of curvature R. It is preferred that the inclination difference of the radius of curvature R is equal to or less than 2500 μm. It is still further preferred that the inclination difference is equal to or less than 1200 μm. For example, in the liquid ejection head 2, the electromechanical transducer elements 30 are provided for each pressure chamber 10*x*. In this case, if it is assumed that the amount of curvature of the diaphragm 20 for each pressure chamber 10*x* is equivalent to the radius of curvature R, it is preferred that the inclination difference of the radius of curvature R in the array direction of the electromechanical transducer elements 30 (or the array direction of the liquid ejection head 1) is equal to or less than 2500 μm. It is still further preferred that the inclination difference is equal to or less than 1200 μm. If the inclination difference of the radius of curvature R exceeds this value, the inclination of the amounts of displacement for the electromechanical transducer elements 30 arrayed in the row is too great to obtain stable ink ejection characteristics.

The factors which may cause the inclination difference of the radius of curvature R of the diaphragm 20 include: (1) the dispersion in the film stress/rigidity of the electromechanical transducer film 32; (2) the film stress (nominal)/the rigidity (nominal) of the electromechanical transducer film 32; and (3) the dispersion in the film stress/the rigidity of other elements (in particular, the diaphragm 20) different from the electromechanical transducer film 32.

Regarding the factors (1) and (3), optimization of the process conditions may improve the dispersion to some extent. However, the process conditions are dependent on the device specifications, and it is difficult to prevent the dispersion thoroughly. In a case in which a diaphragm formed by laminating plural layers to provide increased rigidity is used, the devices and process conditions to form the layers are also different, and not only the dispersion in the wafer surface but also the dispersion between the wafers may take place.

Regarding the factor (2), increasing the film stress (nominal)/the rigidity (nominal) of the electromechanical transducer film 32 may prevent the dispersion in the deflection of the diaphragm 20 although some amount of the film stress or the rigidity of the diaphragm 20 may take place. It is found by the consideration of the inventor that increasing the film stress (nominal)/the rigidity (nominal) of the electromechanical transducer film 32 is effective to reduce the inclination difference of the radius of curvature R of the diaphragm 20 to be 2500 μm or less.

A method of measuring the film stress (nominal) of the electromechanical transducer film 32 is described. First, when the lower electrode 31 is formed as a film on the wafer, a radius of curvature "R_L" is computed as shown in FIG. 5B, and when the electromechanical transducer film 32 is continuously formed as a film thereon, a radius of curvature "R_P" is measured. Then, a radius of curvature "R_P2" as a result of the formation of the electromechanical transducer film 32 may be computed in accordance with Formula 1 below.

$$R_P2=(R_L\times R_P)/(R_L-R_P) \quad \text{[Formula 1]}$$

Further, a pure film stress "σ" when the electromechanical transducer film 32 is formed as a film may be computed in accordance with Formula 2 below which is the Stoney equation. Note that, in Formula 2 below, $E_S$ denotes a Young's modulus of the substrate 10, $\nu_S$ denotes a Poisson's ratio of the substrate 10, $t_S$ denotes a thickness of the substrate 10, and $t_F$ denotes a thickness of the electromechanical transducer film 32.

$$\sigma = \frac{E_S t_S^2}{6(1-\nu_S)Rt_F} \quad \text{[Formula 2]}$$

It is preferred that the film stress "o" of the electromechanical transducer film 32 computed in accordance with the Formula 2 above is equal to or greater than 100 MPa. It is still further preferred that the computed film stress σ is equal to or greater than 200 MPa. By setting the film stress σ of the electromechanical transducer film 32 to this value, the inclination of the amounts of displacement for the electromechanical transducer elements 30 arrayed in the row may be prevented.

Figure 8:
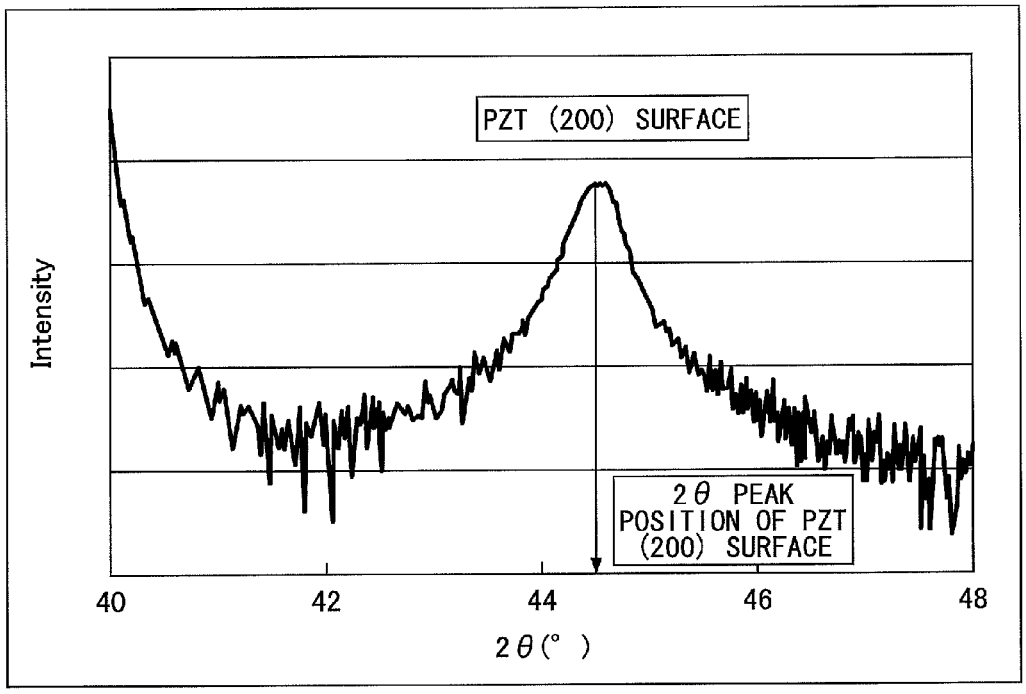
FIG. 8 is a diagram for explaining an X-ray diffraction measurement of PZT.

Note that, when PZT (lead zirconate titanate) is used as a material of the electromechanical transducer film 32 (which will be described later), a peak position of a PZT (200) surface may be substituted as a substitution value of the film stress. FIG. 8 shows a peak position of a PZT (200) surface obtained according to the θ-2θ method in X-ray diffraction (XRD). There is a tendency that the film stress increases if the peak position of the PZT (200) surface shifts toward the greater angle side, and there is a tendency that the film stress decreases if the peak position of the PZT (200) surface shifts toward the smaller angle side.

In a state of the liquid ejection head 2 in which the PZT film which is the electromechanical transducer film 32 has no restraint of the substrate 10, it is preferred that "2θ" as the peak position of the PZT (200) surface by the X ray diffraction is in a range of 44.45° and 44.75°. It is still further preferred that "2θ" is in a range between 44.60° and 44.70°. If the "2θ" does not fall within the above range and is smaller than the lower limit, the film stress of the PZT film becomes too small. When the dispersion in the film stress of other elements different from the PZT film takes place, the inclination of the amounts of displacement for the electromechanical transducer elements 30 of the chips in the row on the outer peripheral portion of the wafer becomes great. If the "2θ" is greater than the upper limit, it is impossible to obtain sufficient amounts of displacement for the electromechanical transducer films 32.

As described above, in order to enable the inclination difference of the radius of curvature R of the diaphragm 20 to fall within the above range, increasing the film stress (nominal)/the rigidity (nominal) of the electromechanical transducer film 32 is effective. However, it is necessary to prevent the dispersion in the film stress/the rigidity of the PZT film and prevent the dispersion in the film stress/the rigidity of the other elements (in particular, the diaphragm 20) different from the PZT film on the wafer surface to some extent. Specifically, it is necessary to prevent the dispersion of the electromechanical transducer films 32 or the diaphragm 20 on the wafer surface. It is preferred that the ratio of (film thickness(max)−film thickness(min))/(film thickness(max)+film thickness(min)) of the chips on the outer peripheral portion of the wafer as the dispersion in the film thickness is equal to or less than 5%. It is still further preferred that the ratio is equal to or less than 3%.

It is preferred that an average value of the radii of curvature R of the diaphragm 20 in the distribution for the electromechanical transducer elements 30 in the row is in a range between 2000 μm and 5000 μm. It is still further preferred that the average value is in a range between 2500 μm and 4500 μm. If the average value is smaller than the lower limit, it is impossible to obtain sufficient amounts of displacement for the electromechanical transducer films 32. If the average value is greater than the upper limit, deterioration of the durability may take place such that the amount of change from an initial strain to a post-actuation strain during a consecutive actuation becomes too great.

Figure 9:
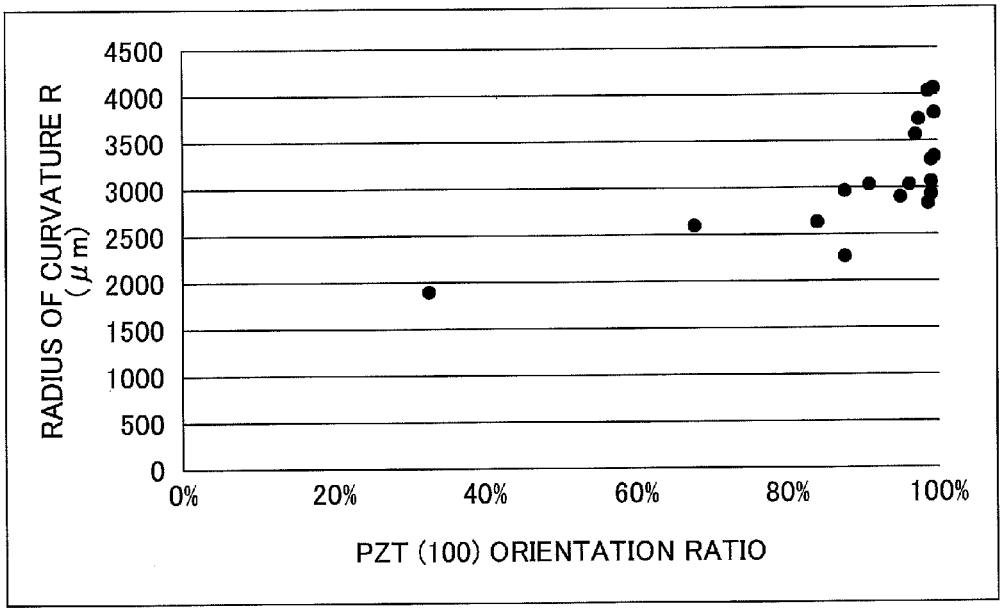
FIG. 9 is a diagram for explaining a PZT (100) preferred orientation film.

When a PZT film is selected as a material of the electromechanical transducer film 32, it is possible to reduce the stress and control the radius of curvature R of the diaphragm 20 to be a great value (a small amount of deflection) by using a PZT (100) preferred orientation film as shown in FIG. 9.

It is found that, when platinum (Pt) is used as a material of the lower electrode 31, the radius of curvature R of the diaphragm 20 is greatly influenced by a film formation temperature of Pt and a material of a seed layer formed on the Pt layer. It is possible to control the radius of curvature R to be a desired value by setting the film formation temperature of Pt to 300° C., or higher and using $PbTiO_3$ as a material of the seed layer.

In the manufacturing processes of the liquid ejection head 2, a polarization process is performed in order to prevent the problem of the deterioration of the durability such that the amount of change from an initial strain to a post-actuation strain during a consecutive actuation becomes great. If the polarization process is not performed, the radius of curvature R of the diaphragm 20 becomes too great (a too small amount of deflection) and it is impossible to prevent the deterioration of the durability.

Next, appropriate materials to constitute the liquid ejection head 2 will be described in greater detail. It is preferred to select a silicon monocrystal substrate as a material of the substrate 10. It is preferred that the substrate 10 normally has a thickness in a range between 100 μm and 600 μm. There are three orientations of (100), (110) and (111). Generally, in the field of semiconductor fabrication, (100) and (111) are used widely. For the liquid ejection head 2, a silicon monocrystal substrate with the orientation of (100) is primarily used.

When forming the pressure chamber 10*x*, the silicon monocrystal substrate is processed by etching. It is preferred to use an anisotropic etching process as an etching process in this case. Note that anisotropic etching employs a feature that an etching rate in the direction normal to the surface is much higher than in the direction parallel to the surface.

For example, in a case of an anisotropic etching process using immersion of the element to be etched into an alkali solution, such as KOH, an etching rate of (111) face is only about 1/400th of an etching rate of (100) face. A structure with about 54° inclination may be formed in the orientation of (100), and a deep trench may be formed in the orientation of (110). Hence, a silicon monocrystal substrate with the orientation of (110) may be used for the liquid ejection head 2 in order to provide increased array density and good rigidity. However, care should be taken on the point that a layer of $SiO_2$ as a mask material is also etched in this case.

It is preferred that the pressure chamber 10*x* has a width (a length in the lateral direction) in a range between 50 μm and 70 μm. It is still further preferred that the width is in a range between 55 μm and 65 μm. If the width is greater than the upper limit, the residual vibration is increased and maintaining the liquid ejection performance at high frequencies is difficult. If the width is smaller than the lower limit, the amounts of displacement are lowered and obtaining good ejection voltage is impossible.

The diaphragm 20 is deformed in response to the force generated by the electromechanical transducer film 32 and causes the nozzle to eject the ink droplets from the pressure chamber 10*x*. Hence, it is preferred that the diaphragm 20 has a predetermined strength. Specifically, the diaphragm 20 may be made of one of Si, $SiO_2$ and $Si_3N_4$ and formed by CVD (chemical vapor deposition). Further, it is preferred to select a material of the diaphragm 20 having a coefficient of linear expansion close to those of the materials of the lower electrode 31 and the electromechanical transducer film 32.

When the PZT is used as the material of the electromechanical transducer film 32, it is preferred to select a material of the diaphragm 20 having a coefficient of linear expansion in a range between $5\times10^{-6}$(1/K) and $10\times10^{-6}$(1/K) which is close to $8\times10^{-6}$(1/K) as the coefficient of linear expansion of the PZT. It is still further preferred to select a material having a coefficient of linear expansion in a range between $7\times10^{-6}$(1/K) and $9\times10^{-6}$(1/K).

Specific materials of the diaphragm 20 may include aluminum oxide, zirconium oxide, iridium oxide, ruthenium oxide, tantalum oxide, hafnium oxide, osmium oxide, rhenium oxide, rhodium oxide, palladium oxide, those compounds, etc. Using any of these materials, the diaphragm 20 may be formed with a spin coater using the sputtering process or the sol-gel process.

It is preferred that the diaphragm 20 has a film thickness in a range of 1 to 3 μm. It is still further preferred that the film thickness of the diaphragm 20 is in a range of 1.5 to 2.5 μm. If the film thickness is smaller than the lower limit, processing the pressure chamber 10*x* is difficult. If the film thickness is greater than the upper limit, the deformation of the diaphragm 20 becomes difficult and the ejection of ink droplets becomes unstable.

As a metallic material of the lower electrode 31 and the upper electrode 33, platinum (Pt) which has high heat resistance and low reactivity may be used. However, there may be a case in which platinum does not provide a good barrier property to lead. In such a case, any of platinum group metals, such as iridium and rhodium, or an alloy of these elements may be used instead.

Note that, when platinum is used as the material of the lower electrode 31 and the upper electrode 33, such platinum layers have poor adhesion with the diaphragm 20 (in particular, $SiO_2$) and it is preferred that the lower electrode 31 and the upper electrode 33 are laminated on the diaphragm 20 via adhesion layers of Ti, $TiO_2$, Ta, $Ta_2O_5$, or $Ta_3N_5$. As a method of forming the lower electrode 31 and the upper electrode 33, a vacuum deposition process, such as sputtering or vacuum evaporation, may be used. It is preferred that each of the lower electrode 31 and the upper electrode 33 has a film thickness in a range of 0.05-1 μm. It is still further preferred that the film thickness of each of the lower electrode 31 and the upper electrode 33 is in a range of 0.1-0.5 μm.

In the lower electrode 31 and the upper electrode 33, an oxide electrode film of $SrRuO_3$ or $LaNiO_3$ may be formed between the corresponding metallic material and the electromechanical transducer film 32. Note that the oxide electrode film between the lower electrode 31 and the electromechanical transducer film 32 may affect the orientation control of the electromechanical transducer film 32 (e.g., a PZT film) formed thereon, and the material to be selected varies depending on the preferred orientation.

When the PZT is used as the material of the electromechanical transducer film 32 in the liquid ejection head 2 and the PZT (100) preferred orientation is applied, it is preferred that a seed layer of $LaNiO_3$, $TiO_2$ or $PbTiO_3$ is formed on the metallic material as the lower electrode 31, and thereafter the PZT film is formed on the seed layer.

A SRO ($SrRuO_3$) film may be used as the oxide electrode film between the upper electrode 33 and the electromechanical transducer film 32. It is preferred that the SRO film has a film thickness in a range of 20-80 nm. It is still further preferred that the film thickness of the SRO film is in a range of 30-50 nm. If this film thickness is smaller than the lower limit, sufficient initial displacement characteristics and good displacement deterioration characteristics may not be obtained. If this film thickness is greater than the upper limit, the PZT film may have poor dielectric strength and leakage may occur.

As described above, the PZT (lead zirconate titanate) may be used as the material of the electromechanical transducer film 32. Note that PZT is a solid solution of lead zirconate ($PbZrO_3$) and lead titanate ($PbTiO_3$) and the characteristics of PZT vary depending on the ratio of $PbZrO_3$ and $PbTiO_3$. For example, when the ratio of $PbZrO_3$ and $PbTiO_3$=53:47, the PZT is represented by the chemical formula $Pb(Zr_{0.53}, Ti_{0.47})O_3$ or simply indicated by PZT (53/47).

As a method of forming the electromechanical transducer film 32, the sputtering process or the sol-gel process may be used, and the electromechanical transducer film 32 may be formed with a spin coater. In this case, patterning is needed and a desired pattern may be obtained by using a photolithographic etching process.

When PZT is produced by the sol-gel process, compounds of lead acetate, zirconium alkoxide, and titanium alkoxide are used as start materials. The start materials are dissolved in methoxyethanol as a common solvent to obtain a homogeneous solution so that a PZT precursor solution can be produced. A hydrolysis reaction of a metal alkoxide compound easily occurs due to the moisture in atmospheric air, and a proper quantity of a stabilizer, such as acetylacetone, acetic acid, diethanolamines, etc., may be added to the PZT precursor solution.

When a PZT film is formed on the overall surface of the lower electrode 31, a coating film is formed by a solution applying process, such as spin coating, and the PZT film is obtained by performing heat treatment steps of solvent desiccation, thermal decomposition and crystallization. Volume contraction occurs when the coating film is transformed into a crystallized film. In order to obtain a crack-free film, adjustment of concentration of the PZT precursor such that a film thickness of 100 nm or less may be obtained by one step is required.

It is preferred that the electromechanical transducer film 32 has a film thickness in a range of 1-3 μm. It is still further preferred that the film thickness of the electromechanical transducer film 32 is in a range of 1.5-2.5 μm. If this film thickness is smaller than the lower limit, processing of the pressure chamber 10*x* may become difficult. If this film thickness is greater than the upper limit, the deformation or displacement may become difficult and the ejection of ink droplets may become unstable.

When the PZT is used as the material of the electromechanical transducer film 32 and the PZT (100) preferred orientation is applied, it is preferred that, as the composition ratio of Zr/Ti, the composition ratio Ti/(Zr+Ti) is in a range between 0.45 and 0.55. It is still further preferred that the composition ratio Ti/(Zr+Ti) is in a range between 0.48 and 0.52.

A crystal orientation is expressed by the formula $\rho(hkl)=I(hkl)/\Sigma I(hkl)$, where $\rho(hkl)$ denotes an orientation ratio of a crystal plane (hkl), I(hkl) denotes a peak intensity of an arbitrary orientation, and $\Sigma I(hkl)$ is a total sum of the respective peak intensities. The orientation ratio of a crystal plane (100) is computed based on the ratio of the peak intensities of the respective orientations when the total sum of the respective peak intensities obtained by the θ-2θ measurement of the X-ray diffraction method is assumed to be equal to 1. It is preferred that the orientation ratio of the crystal plane (100) is equal to or greater than 0.75. It is still further preferred that the orientation ratio of the crystal plane (100) is equal to or greater than 0.85. If the orientation ratio is smaller than the value, a sufficient piezoelectric distortion may not be obtained and a sufficient amount of displacement for the electromechanical transducer film 32 may not be provided.

As the electromechanical transducer film 32, an $ABO_3$ perovskite type crystalline film other than the PZT film may be used. As the $ABO_3$ perovskite type crystalline film other than the PZT film, a non-lead composite oxide film, such as a barium titanate film, may be used. In this case, it is possible to produce a barium titanate precursor solution by dissolving start materials of compounds of barium alcoxide and titanium alkoxide in a common solvent.

These materials are represented by a generic formula $ABO_3$ and correspond to composite oxides which contain A=Pb, Ba, Sr and B=Ti, Zr, Sn, Ni, Zn, Mg, Nb as the main ingredients. Specific examples of the composite oxides include $(Pb_{1-x}, Ba)(Zr, Ti)O_3$ and $(Pb_{1-x}, Sr)(Zr, Ti)O_3$ wherein a part of Pb of the A site is substituted by Ba or Sr. Such substitution is possible if it is a bivalent element, and the substitution may provide reduction of the characteristic degradation due to the evaporation of lead during heat treatment.

Figure 10A:
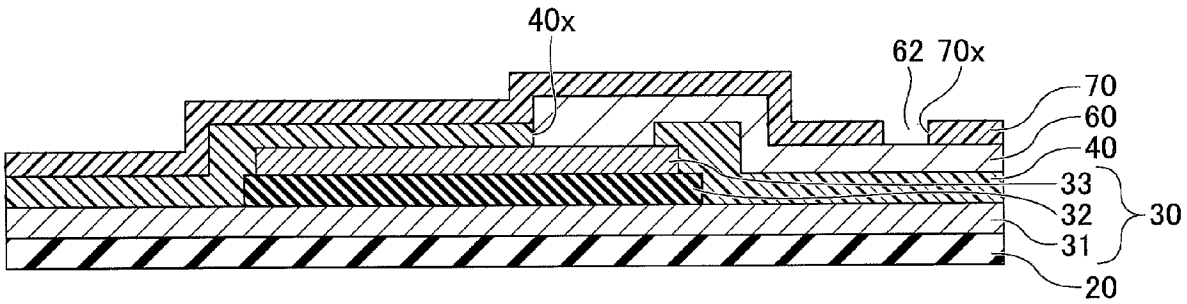
FIG. 10A and FIG. 10B are diagrams showing a wiring pattern of the liquid ejection head according to the first embodiment.
Figure 10B:
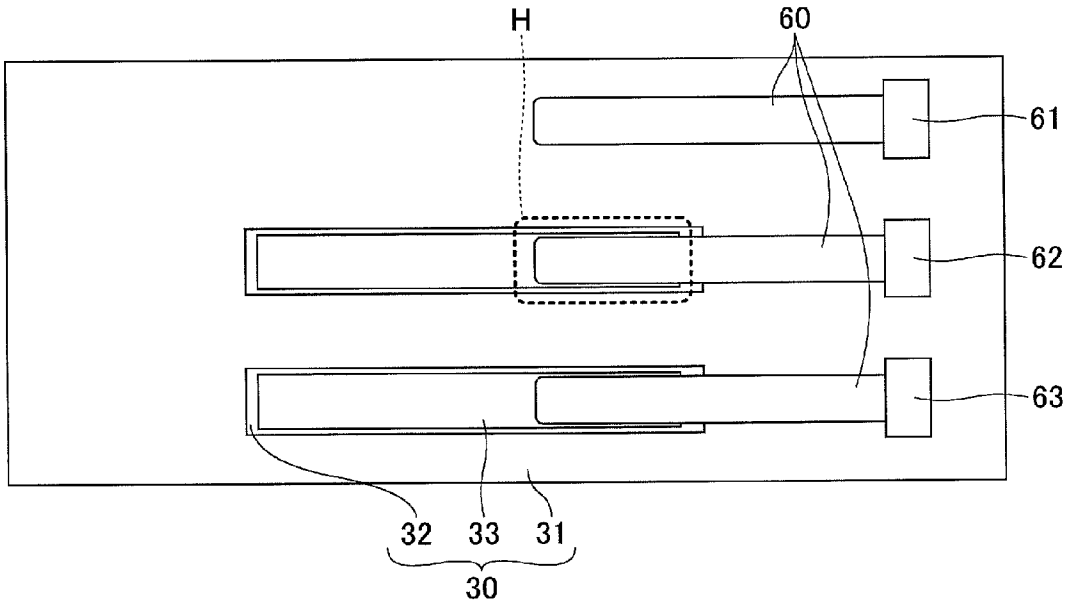

Next, a configuration of the liquid ejection head including a wiring pattern is described. FIG. 10A and FIG. 10B are diagrams showing a wiring pattern of the liquid ejection head according to the first embodiment. FIG. 10A is a cross-sectional view of the liquid ejection head and FIG. 10B is a plan view of the liquid ejection head. In FIG. 10B, the illustration of the insulation protective films 40 and 70 is omitted.

As shown in FIG. 10A and FIG. 10B, a wiring pattern 60 is formed on the insulation protective film 40, and the insulation protective film 70 is formed on the wiring pattern 60. The insulation protective film 40 includes a plurality of openings 40*x*, and a surface of the lower electrode 31 or the upper electrode 33 is exposed in each of the openings 40*x*. Each of the openings 40*x* is filled with the wiring pattern 60. The wiring pattern 60 includes a wiring portion connected to the upper electrode 33 (at a portion of a contact hole H indicated by the dotted line in FIG. 10B), and a wiring portion connected to the lower electrode 31.

The insulation protective film 70 includes a plurality of openings 70*x* and a surface of the wiring pattern 60 is exposed in each of the openings 70*x*. Electrode pads 61, 62, and 63 are provided on the exposed portions of the wiring pattern 60 in the openings 70*x*, respectively. The electrode pad 61 is a common electrode pad, and this common electrode pad 61 is connected via the wiring pattern 60 to the lower electrode 31 which is common to the electromechanical transducer elements 30. The electrode pads 62 and 63 are individual electrode pads, and the individual electrode pads 62 and 63 are connected via the wiring pattern 60 to the upper electrodes 33 which are provided individually for the electromechanical transducer elements 30.

Figure 11:
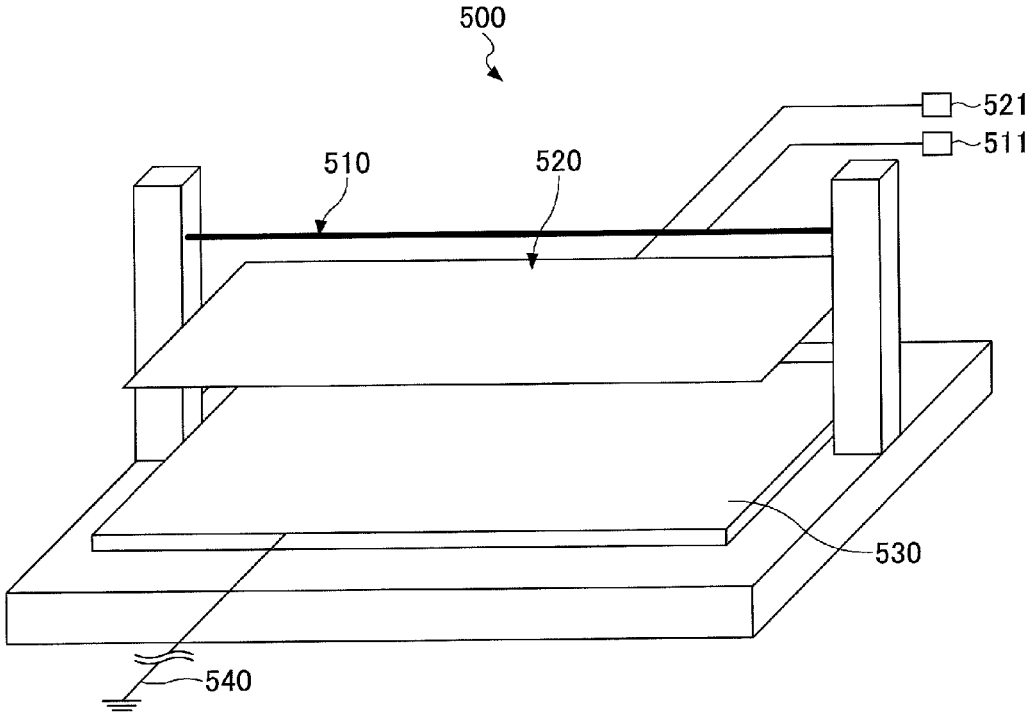
FIG. 11 is a diagram showing an outline configuration of a polarization process device.

Next, a polarization process device is described. FIG. 11 shows an outline configuration of a polarization process device 500. As shown in FIG. 11, the polarization process device 500 includes a corona electrode 510 and a grid electrode 520. The corona electrode 510 and the grid electrode 520 are connected to a corona-electrode power source 511 and a grid-electrode power source 521, respectively. A stage 530 on which a sample is placed is provided with a temperature adjustment function. A polarization process may be performed on the sample placed on the stage 530 while applying heat to the sample to a temperature of 350° C., at the maximum. A grounding cable 540 is connected to the stage 530. When the grounding cable 540 is disconnected from the stage 530, the polarization process is inhibited from being started without grounding.

For example, mesh processing is performed on the grid electrode 520. The grid electrode 520 is configured so that, when high voltage is applied to the corona electrode 510, ions and charge generated by the corona discharging may efficiently fall down to the stage 530 and be implanted into the electromechanical transducer film 32 of the sample. The intensity of the corona discharging may be adjusted by changing the level of the voltage applied to the corona electrode 510 or the grid electrode 520, and the distance between the sample and the electrodes.

Figure 12:
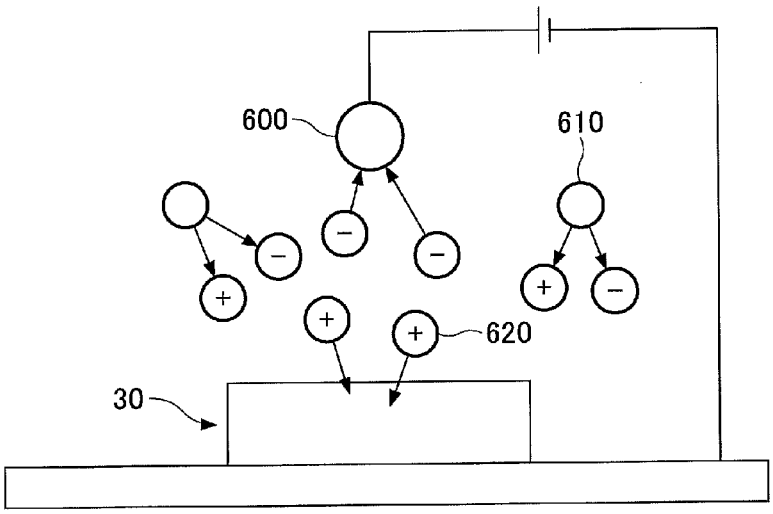
FIG. 12 is a diagram for explaining corona discharging.

As shown in FIG. 12, when the corona discharging is performed by using a corona wire 600, molecules 610 in the atmospheric air are ionized and positive ions 620 are generated. Then, the generated positive ions 620 flow through the pad portions into the electromechanical transducer element 30, so that the charge may be injected into the electromechanical transducer element 30.

In this case, it is considered that an internal potential difference arises by a charge difference between the upper electrode and the lower electrode and the polarization process is performed. Although the amount of charge Q required for the polarization process at this time is not limited, it is preferred that the amount of charge accumulated in the electromechanical transducer element 30 is greater than $1.0\times10^{-8}$ C. It is still further preferred that the amount of charge accumulated is greater than $4.0\times10^{-8}$ C. If the amount of charge accumulated is less than this value, a sufficient polarization process may not be performed and good characteristics of the PZT piezoelectric actuator against the displacement deterioration after a continuous actuation may not be obtained.

Figure 13A:
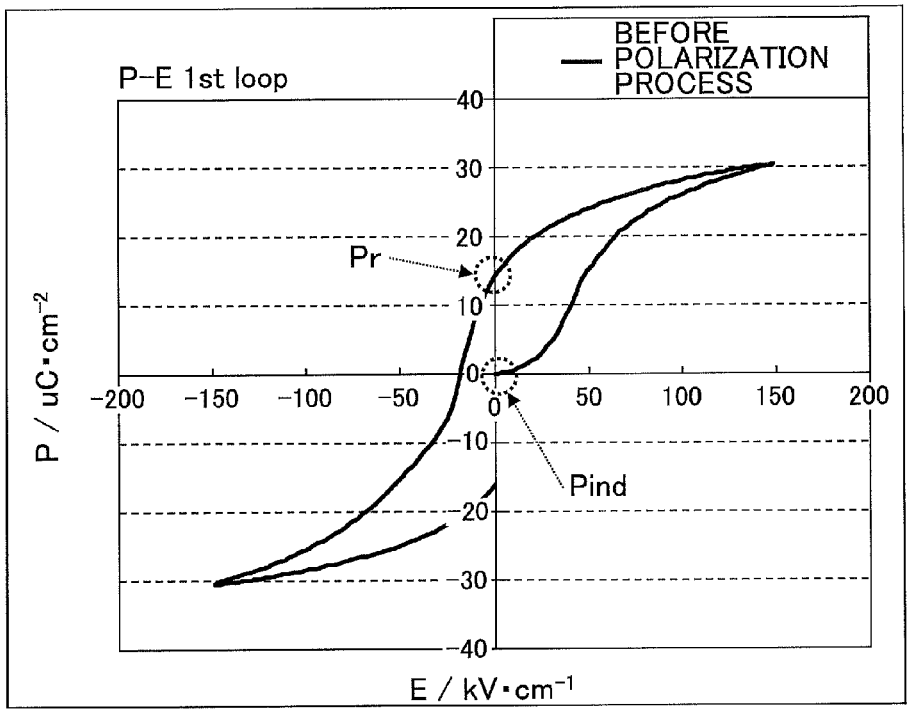
FIG. 13A and FIG. 13B are diagrams for explaining a P-E hysteresis loop.

A polarization state of the electromechanical transducer element 30 by the polarization process may be determined based on a P-E hysteresis loop of the electromechanical transducer element 30. A method of determining the polarization state of the electromechanical transducer element 30 is described with reference to FIG. 13A and FIG. 13B. FIG. 13A shows a P-E hysteresis loop before the polarization process and FIG. 13B shows a P-E hysteresis loop after the polarization process.

Figure 13B:
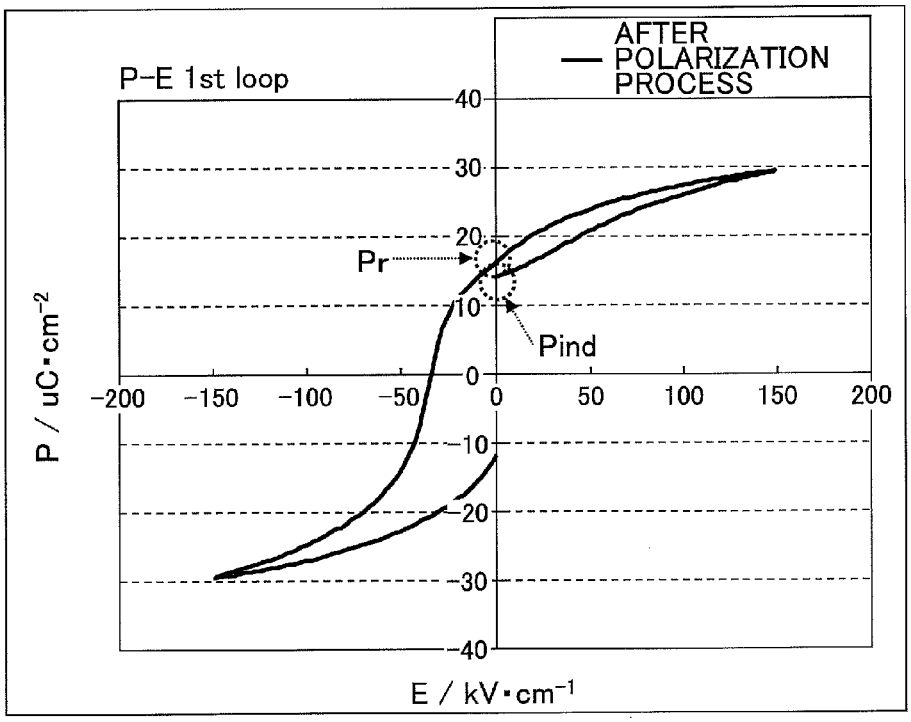

As shown in FIG. 13A and FIG. 13B, a hysteresis loop is measured by applying electric-field intensities of ±150 kV/cm. A polarizability is defined by a value of (Pr−Pind) where Pind denotes a polarization at 0 kV/cm for the first time, and Pr denotes a polarization at 0 kV/cm when the electric-field intensity is returned to 0 kV/cm after the electric-field intensity of +150 kV/cm is applied. The polarization state of the electromechanical transducer element 30 may be determined based on the polarizability.

It is preferred that the polarizability (Pr−Pind) is equal to or less than 10 $\mu C/cm^2$. It is still further preferred that the polarizability (Pr−Pind) is equal to or less than 5 $\mu C/cm^2$. If the polarizability (Pr−Pind) is greater than this value, good characteristics of the PZT piezoelectric actuator against the displacement deterioration after a continuous actuation may not be obtained. Note that a desired value of the polarizability (Pr−Pind) may be obtained by adjusting the voltage applied to the corona electrode 510 and the grid electrode 520 shown in FIG. 11, the distance between the stage 530 and the corona electrode 510, and distance between the stage 530 and the grid electrode 520. However, when it is intended to obtain a desired value of the polarizability (Pr−Pind), it is preferred to generate a high electric field to the electromechanical transducer film 32.

Second Embodiment

Next, a liquid ejection device according to a second embodiment including the liquid ejection head 2 (shown in FIG. 3) will be described.

Figure 14:
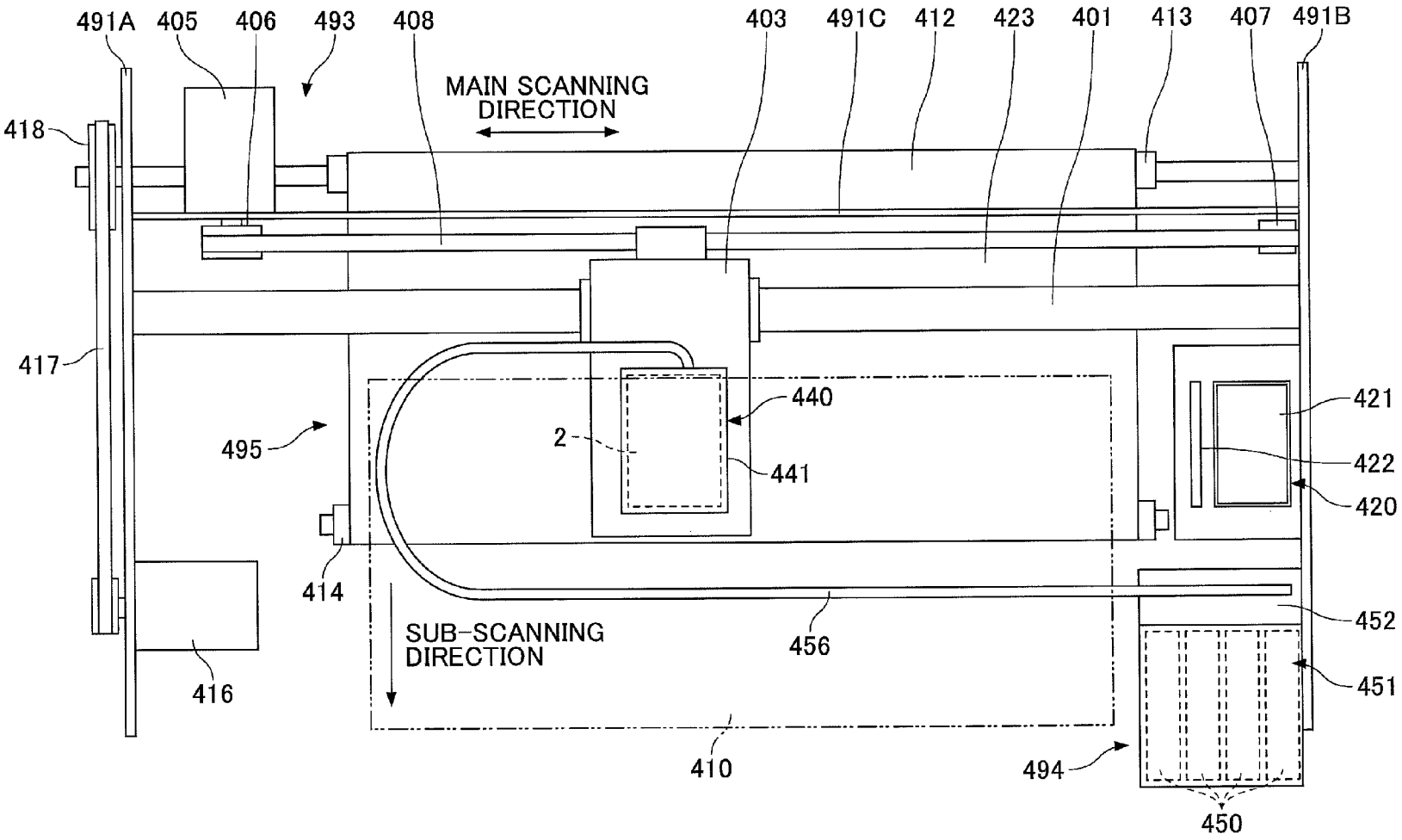
FIG. 14 is a plan view of a liquid ejection device according to a second embodiment.

First, an example of the liquid ejection device according to the second embodiment is described with reference to FIG. 14 and FIG. 15. FIG. 14 is a plan view of the liquid ejection device, and FIG. 15 is a side view of the liquid ejection device.

Figure 15:
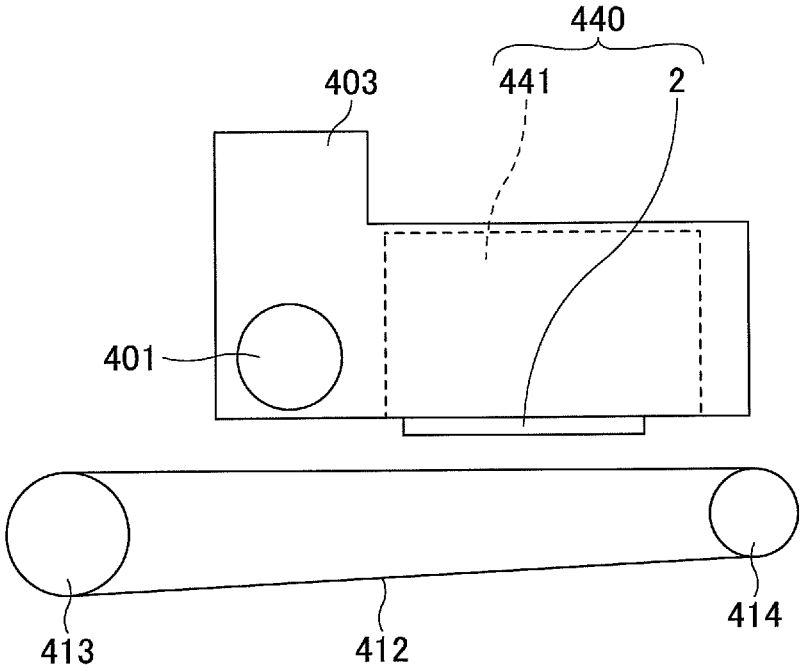
FIG. 15 is a side view of the liquid ejection device according to the second embodiment.

As shown in FIG. 14 and FIG. 15, the liquid ejection device is a serial type device in which a reciprocation movement of a carriage 403 in a main scanning direction is caused by a scanning movement mechanism 493. The scanning movement mechanism 493 includes a guide member 401, a main-scanning motor 405, and a timing belt 408. The guide member 401 is interposed between a side plate 491A and a side plate 491B to hold the carriage 403 in a movable manner. The timing belt 408 is wound between a driving pulley 406 and a driven pulley 407. The reciprocation movement of the carriage 403 in the main scanning direction is caused by the main-scanning motor 405 through the timing belt 408.

On this carriage 403, a liquid ejection unit 440 in which the liquid ejection head 2 according to the first embodiment is incorporated together with a head tank 441 is mounted. For example, the liquid ejection head 2 of the liquid ejection unit 440 is configured to eject liquid droplets of respective colors of yellow (Y), cyan (C), magenta (M), and black (K). Further, in the liquid ejection head 2, a nozzle row including nozzles 51 is arranged in a sub-scanning direction perpendicular to the main scanning direction, and the nozzle row is attached to the liquid ejection head 2 so that the ejection direction is turned to a downward direction.

A supply mechanism 494 is provided outside the liquid ejection head 2 to supply the stored liquid to the liquid ejection head 2. The liquid stored in liquid cartridges 451 is supplied to the head tank 441 by the supply mechanism 494.

The supply mechanism 494 includes a cartridge holder 451 on which the liquid cartridges 450 are mounted, a tube 456, and a liquid feeding unit 452 containing a liquid feeding pump. The liquid cartridges 450 are detachably attached to the cartridge holder 451. The liquid from the liquid cartridges 450 is fed to the head tank 441 via the tube 456 by the liquid feeding unit 452.

The liquid ejection device includes a transport mechanism 495 to transport a sheet 410 in the sub-scanning direction in the liquid ejection device. The transport mechanism 495 includes a transport belt 412 as a sheet carrying unit, and a sub-scanning motor 416 to drive and move the transport belt 412.

The transport belt 412 transports the sheet 410 in the position where the sheet 410 counters the liquid ejection head 2, while attracting the sheet 410. This transport belt 412 is an endless belt and wound between a transport roller 413 and a tension roller 414. The attraction of the sheet 410 may be performed by electrostatic attraction or air suction.

The transport belt 412 performs circular movement in the sub-scanning direction when the transport roller 413 is rotated through a timing belt 417 and a timing pulley 418 by the sub-scanning motor 416.

In addition, a maintenance recovery mechanism 420 is arranged on the side of the transport belt 412 at an end portion of the carriage 403 in the main scanning direction, and this maintenance recovery mechanism 420 performs maintenance and recovery for the liquid ejection head 2.

For example, the maintenance recovery mechanism 420 includes a cap member 421 to perform capping of nozzle surfaces (the surfaces in which the nozzles 51 are formed) of the liquid ejection head 2, and a wiper member 422 to wipe the nozzle surfaces.

The scanning movement mechanism 493, the supply mechanism 494, the maintenance recovery mechanism 420, and the transport mechanism 495 are attached to a casing including side plates 491A and 491B and a back plate 491C.

In the above-described liquid ejection device, the sheet 410 is fed to the transport belt 412 and the sheet 410, while being attracted, is transported by the circular movement of the transport belt 412 in the sub-scanning direction.

While the carriage 403 is moved in the main scanning direction, the liquid ejection head 2 is driven in accordance with an image signal to eject liquid droplets onto the stopped sheet 410 so that an image is formed on the sheet 410.

The liquid ejection head according to the first embodiment is incorporated in the above-described liquid ejection device, and it is possible to provide stable ink ejection characteristics so that an image with high quality may be formed.

Figure 16:
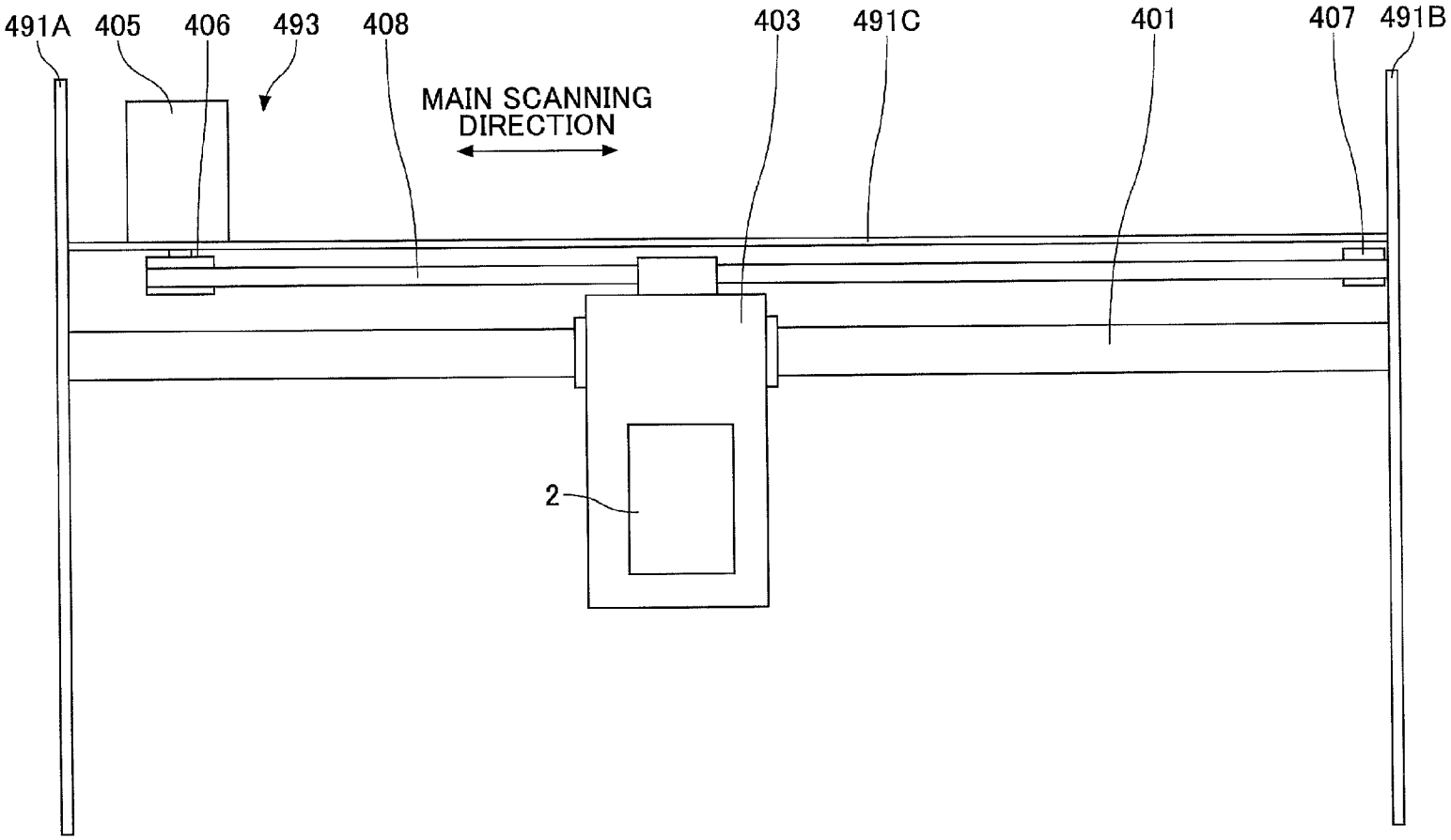
FIG. 16 is a plan view of a modification of a liquid ejection unit according to the second embodiment.

Next, a modification of the liquid ejection unit according to the second embodiment will be described with reference to FIG. 16. FIG. 16 is a plan view of the modification of the liquid ejection unit according to the second embodiment. In FIG. 16, the elements which are the same as corresponding elements in FIG. 14 are designated by the same reference numerals, and a description thereof will be omitted.

As shown in FIG. 16, this liquid ejection unit is constituted by the casing including the side plates 491A and 491B and the back plate 491C, the scanning movement mechanism 493, the carriage 403, and the liquid ejection head 2 among the elements of the previously described liquid ejection device.

Note that at least one of the previously described maintenance recovery mechanism 420 and the supply mechanism 494 may be additionally mounted on, for example, the side plate 491B of this liquid ejection unit.

Figure 17:
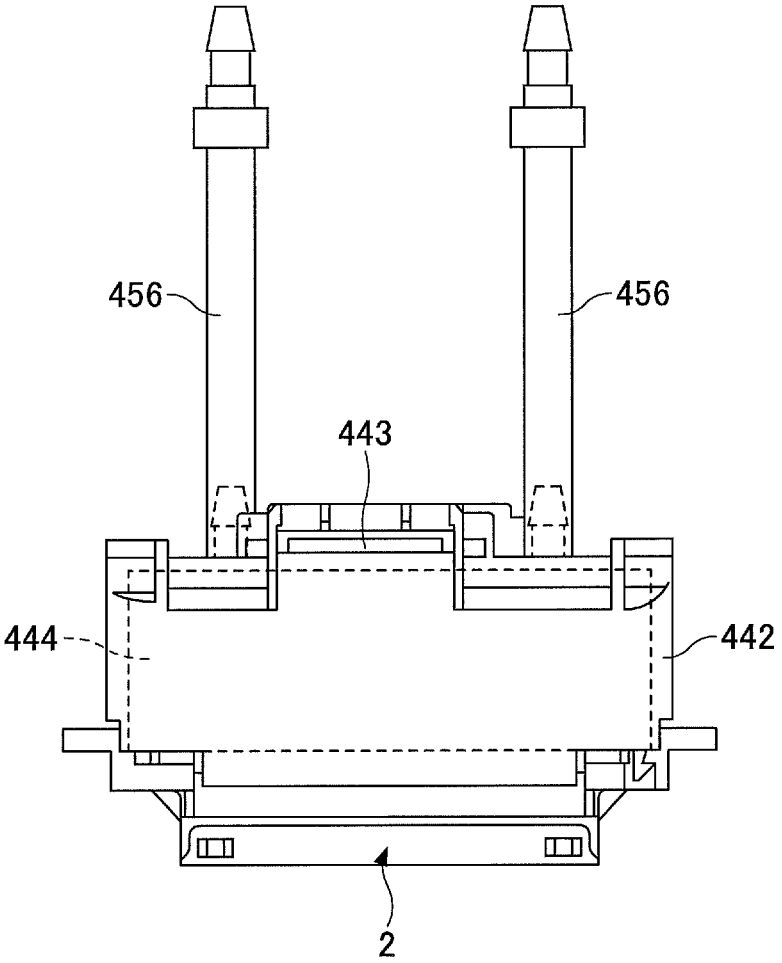
FIG. 17 is a front view of another modification of the liquid ejection unit according to the second embodiment.

Next, another modification of the liquid ejection unit according to the second embodiment will be described with reference to FIG. 17. FIG. 17 is a front view of the other modification of the liquid ejection unit according to the second embodiment.

As shown in FIG. 17, this liquid ejection unit includes the liquid ejection head 2 on which a passage component 444 is mounted, and tubes 456 connected to the passage component 444.

The passage component 444 is arranged within a cover 442. Instead of the passage component 444, the previously described head tank 441 may be arranged within the cover 442. Further, a connector 443 which is electrically connected to the liquid ejection head 2 is arranged at an upper portion of the passage component 444.

In the foregoing description, the liquid ejection device is a device which includes the liquid ejection head or the liquid ejection unit and is configured to drive the liquid ejection head to eject liquid droplets. The liquid ejection device may include not only a device configured to eject liquid to a sheet medium but also a device configured to eject liquid to a gas or liquid fluid.

The liquid ejection device may include supplemental mechanisms related to sheet feeding, sheet transport and sheet ejection, a pre-processing device, a post-processing device, etc.

For example, the liquid ejection device may include an image forming apparatus which ejects ink droplets to form an image on paper, and a solid modeling device (or a three-dimensional modeling device) which ejects modeling liquid to powder layers laminated with powder to perform solid modeling (or three-dimensional modeling).

Further, the liquid ejection device is not limited to devices to eject liquid and visualize significant images, such as characters and figures, with the ejected liquid. For example, the liquid ejection device may include a device to form a pattern which is not significant by itself, and a device to model a three dimensional image. Further, the sheet may include a medium to which liquid adheres temporarily, a medium to which liquid adheres and is fixed, and a medium to which liquid adheres and is permeated. For example, the sheet may include recording media such as copy sheets, record paper, films and cloth, electronic parts such as electronic substrates and piezoelectric elements, and other media such as powder layers, organ models and inspection cells. Unless otherwise specified, the sheet may include all the things to which liquid adheres.

The material of the sheet may include paper, yarn, fiber, leather, metal, plastics, glass, wood, and ceramics, to which liquid adheres at least temporarily.

The liquid may include ink, processing liquid, DNA samples, resists, pattern materials, binding agents, modeling liquid, amino acid, protein, calcium-contained solutions, dispersion liquid, etc.

The liquid ejection device may include a device in which a liquid ejection head and a sheet move relative to each other. However, the liquid ejection device is not limited to this device. For example, the liquid ejection device may include a serial type device in which a liquid ejection head is moved, and a line type device in which a liquid ejection head is not moved.

The liquid ejection device may further include a processing liquid coating device which ejects processing liquid to a surface of a sheet to apply the processing liquid to the sheet surface for improvement of the sheet surface, and an injecting granulation device which ejects composition liquid containing a raw material dispersed in a solution via a nozzle and granulates the raw material into particles.

The liquid ejection unit may be an assembly of component parts related to liquid ejection in which functional components and mechanisms are incorporated in a liquid ejection head. For example, the liquid ejection unit may include a combination of the liquid ejection head with at least one of the head tank, the carriage, the supply mechanism, the maintenance recovery mechanism, and the scanning movement mechanism.

In the liquid ejection unit, the liquid ejection head may be fixed to the functional components and mechanisms by fastening, adhesion, engagement, etc., or one of the liquid ejection head and the functional components and mechanisms may be held movably on the other. Further, one of the liquid ejection head and the functional components and mechanisms may be detachably attached to the other.

For example, the liquid ejection unit may include a unit in which the liquid ejection head and the head tank are incorporated, similar to the liquid ejection unit 440 shown in FIG. 15. The liquid ejection unit may further include a unit in which the liquid ejection head and the head tank are interconnected by tubes or the like and incorporated. Further, the liquid ejection unit may include a unit containing a filter between the head tank and the liquid ejection head which are incorporated.

The liquid ejection unit may include a unit in which the liquid ejection head and the carriage are incorporated.

The liquid ejection head may include a unit in which the liquid ejection head and the scanning movement mechanism are incorporated and the liquid ejection unit is held movably on a guide member which constitutes a part of the scanning movement mechanism. Further, the liquid ejection unit may include a unit in which the liquid ejection head, the carriage, and the scanning movement mechanism are incorporated as shown in FIG. 16.

Further, the liquid ejection unit may include a unit in which the liquid ejection head, the carriage, and the maintenance recovery mechanism are incorporated and the cap member forming a part of the maintenance recovery mechanism is fixed to the carriage to which the liquid ejection head is attached.

Further, the liquid ejection unit may include a unit in which the liquid ejection head and the supply mechanism are incorporated and the tubes are connected to the liquid ejection head to which the head tank or the passage component is attached as shown in FIG. 17.

The scanning movement mechanism may include a mechanism containing the guide member only. The supply mechanism may include a mechanism containing the tube only or the cartridge holder only.

The pressure generation unit used in the liquid ejection head is not limited to the foregoing embodiments. For example, besides the piezoelectric actuator (which may include lamination type piezoelectric elements) previously described in the foregoing embodiments, a thermal actuator including an electric heat transducer, such as a heating resistor, and an electrostatic actuator including a diaphragm and a counter electrode.

In the present specification, image formation, recording, printed recording, printed output, printing, modeling, etc. are considered synonyms.

Example 1

A 6-inch silicon wafer was prepared as the substrate 10, and on the substrate 10, a $SiO_2$ film (with a film thickness of 600 nm), a Si film (with a film thickness of 200 nm), a $SiO_2$ film (with a film thickness of 100 nm), a SiN film (with a film thickness of 150 nm), a $SiO_2$ film (with a film thickness of 1300 nm), a SiN film (with a film thickness of 150 nm), a $SiO_2$ film (with a film thickness of 100 nm), a Si film (with a film thickness 200 nm), and a $SiO_2$ film (with a film thickness of 600 nm) were deposited in this order so that the diaphragm 20 was produced.

Subsequently, a Ti (titanium) film (with a film thickness of 20 nm) was deposited on the diaphragm 20 as the adhesion layer using a sputtering device at a film formation temperature of 350° C., and thereafter the Ti film was thermally oxidized at 750° C. using a RTA (rapid heat treatment) process. Furthermore, a Pt (platinum) film (with a film thickness of 160 nm) was deposited on the adhesion layer using the sputtering device at a film formation temperature of 400° C., so that the lower electrode 31 was produced.

Next, a solution whose composition ratio was adjusted to Pb:Ti=1:1 to form a $PbTiO_3$ film as a foundation layer, and a solution whose composition ratio was adjusted to Pb:Zr:Ti=115:49:51 to form the electromechanical transducer film 32 were prepared, and these films were formed on the lower electrode 31 using the spin coat method.

A typical method of preparation of a precursor coating liquid is explained. First, compounds of lead acetate trihydrate, titanium isopropoxide, and zirconium isopropoxide were used as start materials. The lead acetate crystalline water after being dissolved in methoxy ethanol was dehydrated. The amount of lead was increased to be greater than the stoichiometric composition amount in order to prevent deterioration of the crystalline characteristics due to lead omission during the heat treatment.

The compounds of titanium isopropoxide and zirconium isopropoxide were dissolved in methoxy ethanol, and the alcoholic exchange reaction and the esterification reaction were advanced, and a PZT precursor solution was produced by mixing them with a methoxy ethanol solution in which the above lead acetate compound was dissolved. The PZT concentration was set to 0.5 mol/liter. Similar to the PZT solution, a PT solution was also produced. Using these solutions, a PT film was first deposited by the spin coating and a desiccation process was performed at 120° C., after the film deposition, and thereafter a PZT film was deposited by the spin coating and a desiccation process was performed at 120° C., and further a thermal decomposition process was performed at 400° C.

After the thermal decomposition process of the third film, a crystallization heat treatment process (at temperature of 730° C.) was performed by RTA.

At this time, the film thickness of the PZT film was 240 nm. The same procedure was repeated 8 times in total (24 layers) and a 2-μm thick PZT film was obtained as the electromechanical transducer film 32.

Subsequently, by performing the sputtering process, a $SrRuO_3$ film (with a film thickness of 40 nm) was deposited as an oxide electrode film to constitute the upper electrode 33, and a Pt (platinum) film (with a film thickness of 125 nm) was deposited as a metallic film. Then, a photoresist film (TSMR8800 from Tokyo Ohka Kogyo Co., Ltd,) was deposited by the spin coating and a resist pattern was formed by a normal photolithographic process, and thereafter the electrode pattern as shown in FIG. 10A was produced using an ICP etching system (from SAMCO). Thereby, the electromechanical transducer element 30 was produced on the diaphragm 20.

Subsequently, on the electromechanical transducer element 30, an $Al_2O_3$ film with a film thickness of 50 nm was deposited as the insulation protective film 40 by using the ALD process. At this time, Al generated by TMA (from Sigma Aldrich Co.) as Al of the raw material and $O_3$ generated by an ozone generator as O of the raw material were laminated alternately and the film deposition was advanced.

Subsequently, as shown in FIG. 10B, the contact hole H was formed by etching. Thereafter, an Al film was deposited by the sputtering process and the wiring pattern 60 was formed by the etching process. Then, a $Si_3N_4$ film with a film thickness of 500 nm was deposited as the insulation protective film 70 by the plasma CVD process. Further, the openings 70*x* were formed in the insulation protective film 70, corresponding parts of the wiring pattern 60 were exposed, and the electrode pads 61, 62, and 63 are produced thereon. Note that the electrode pad 61 is the common electrode pad, the electrode pads 62 and 63 are the individual electrode pads, and the distance between the pads of the individual electrodes is equal to 80 μm.

Subsequently, the polarization process was performed through the corona charging process performed by the polarization process device 500. A wire of W (tungsten) with a diameter of 50 μm was used in the corona charging process. As the polarization process conditions at this time, 9 kV of the voltage of the corona electrode 510, 80° C., of the processing temperature, 2.5 kV of the voltage of the grid electrode 520, 30 seconds of the processing time, 4 mm of the distance between the corona electrode 510 and the grid electrode 520, and 4 mm of the distance between the grid electrode 520 and the stage 530 were used.

Subsequently, the back surface of the substrate 10 was etched and the pressure chamber 10*x* (with a width of 60 μm) was formed so that the liquid ejection head 2 was produced. However, the nozzle plate 50 including the nozzles 51 is not yet bonded to the bottom surface of the substrate 10, and this liquid ejection head 2 is a semifinished product.

Example 2

A liquid ejection head 2 of Example 2 was produced in the same manner as that of Example 1 except that the formation temperature of a platinum film as the lower electrode 31 was 300° C.

Example 3

A liquid ejection head 2 of Example 3 was produced in the same manner as that of Example 1 except that the formation temperature of a platinum film as the lower electrode 31 was 500° C.

Example 4

A liquid ejection head 2 of Example 4 was produced in the same manner as that of Example 1 except that the formation temperature of a platinum film as the lower electrode 31 was 500° C., and the calcination temperature was 300° C.

Example 5

A liquid ejection head 2 of Example 5 was produced in the same manner as that of Example 1 except that the formation temperature of a platinum film as the lower electrode 31 was 300° C., and the solution adjusted by Pb:Zr:Ti=115:47:53 was used for the production of the electromechanical transducer film 32.

Comparative Example 1

A liquid ejection head 2 of Comparative Example 1 was produced in the same manner as that of Example 1 except that the solution adjusted by Pb:Zr:Ti=115:57:43 was used for the production of the electromechanical transducer film 32.

Evaluation of Examples 1-5, Comparative Example 1

Regarding the electromechanical transducer element 30 of each of the produced liquid ejection heads 2 of the Examples 1-5 and the Comparative Example 1, using the chip equivalent to the chip C4 (at the outer peripheral portion of the wafer W) as shown in FIG. 7, the evaluation tests were conducted for the XRD measurements of corresponding positions, the electrical characteristics, the displacement characteristics (piezoelectric constant), and the amounts of curvature of the diaphragm. Note that, for the evaluation of the displacement characteristics, a vibration evaluation test was performed from the pressure chamber 10*x* side. Specifically, an amount of deformation of the electromechanical transducer element 30 by the application of an electric field (150 kV/cm) was measured with a laser doppler vibration meter and computed by the calibration in conformity with the simulation results. Further, the amounts of curvature (the radii of curvature) of the diaphragm 20 were measured using a white-light interference type surface shape measuring machine.

Based on the results of the evaluation tests, the inclination difference of the radius of curvature R, the radius of curvature R for each pressure chamber, the PZT (200) peak position, and the Δδ/δ_ave of the diaphragm 20 were computed, and the computation results are given in Table 1 below. Note that 5 denotes the displacement characteristics of the electromechanical transducer film 32 when the electric field of 150 kV/cm is applied and evaluated, Δδ denotes the inclination difference of the displacement characteristics δ in the array direction of the electromechanical transducer film 32, and δ_ave denotes an average value of the displacement characteristics δ.

Here, when an approximated straight line L is drawn by excluding the 20 channels of the electromechanical transducer elements 30 from one end of the chip C4, similar to FIG. 7, a difference between the displacement characteristics (the amounts of displacement) of the electromechanical transducer elements 30 corresponding to the ends of the approximated straight line L is defined as the inclination difference of the displacement characteristics δ.

Note that, when dummy channels are included, "the 20 channels from the chip ends" are the 20 channels which eject liquid droplets effectively by excluding the dummy channels.

TABLE 1

| | INCLINATION DIFFERENCE OF RADIUS OF CURVATURE R | RADIUS OF CURVATURE R | PEAK POSITION OF PZT(200) | Δ δ/δ_ave |
|---|---|---|---|---|
| EXAMPLE 1 | 800 μm | 3100 μm | 44.65° | 5% |
| EXAMPLE 2 | 500 μm | 2800 μm | 44.68° | 3% |
| EXAMPLE 3 | 1200 μm | 3500 μm | 44.63° | 5% |
| EXAMPLE 4 | 2500 μm | 4800 μm | 44.58° | 8% |
| EXAMPLE 5 | 300 μm | 2500 μm | 44.72° | 2% |
| COMPARATIVE EXAMPLE 1 | 3000 μm | 6200 μm | 44.35° | 15% |

As is apparent from Table 1 above, the inclination difference of the radius of curvature R of the diaphragm 20 of each of the Examples 1-5 was equal to or less than 2500 μm, while the inclination difference of the Comparative Example 1 was greater than 2500 μm. It is to be noted that, when PZT is used as the electromechanical transducer film 32, the inclination difference of the radius of curvature R of the diaphragm 20 may be greater than 2500 μm due to the composition ratio of Zr/Ti.

Further, as is apparent from Table 1 above, the Δδ/δ_ave of each of the Examples 1-5 was equal to or less than 8%, which is a target displacement dispersion of the row arrayed in the chip, while the Δδ/δ_ave of the Comparative Example 1 was a too great dispersion of 15%. Namely, if the inclination difference of the radius of curvature R of the diaphragm 20 is 2500 μm or less, the Δδ/δ_ave is equal to or less than 8%. However, if the inclination difference of the radius of curvature R is greater than 2500 μm, the Δδ/δ_ave exceeds the target displacement dispersion of 8%.

Subsequently, the nozzle plate 50 including the nozzles 51 was bonded to the bottom surface of the substrate 10 of each of the liquid ejection heads 2 (semifinished products) of the Examples 1-5 and the Comparative Example 1 and the production of the liquid ejection head 2 was finished. The evaluation test for the liquid ejection was conducted.

Specifically, using the ink whose viscosity was adjusted to 5 cp, the ejection state of the liquid ejection head 2 was checked when a voltage ranging from −30 V to −10 V was applied according to a simple push waveform. As a result, it was confirmed that all of the nozzles 51 of each of the liquid ejection heads 2 of the Examples 1-5 were able to eject the ink droplets and were able to perform the ink ejection by high frequency. On the other hand, it was confirmed that the liquid ejection head 2 of the Comparative Example 1 showed a too great dispersion of the ink ejection speed in the array direction of the nozzles 51.

Namely, it has been confirmed that if the inclination difference of the radius of curvature R of the diaphragm 20 is 2500 μm or less, the liquid ejection speed is stabilized, but if the inclination difference of the radius of curvature R of the diaphragm 20 is greater than 2500 μm, the liquid ejection speed is not stabilized.

As described in the foregoing, according to the present invention, it is possible to provide a liquid ejection head in which a plurality of electromechanical transducer elements are arrayed, which can provide stable liquid ejection characteristics.

The liquid ejection head according to the present invention is not limited to the above-described embodiments, and variations and modifications may be made without departing from the scope of the present invention. It is to be understood that the foregoing detailed description is exemplary and explanatory and is not restrictive of the invention as claimed.

For example, in the above-described embodiments, the liquid ejection head in which the upper electrode is used as the individual electrode and the lower electrode is used as the common electrode has been described. However, the present invention is not limited to these embodiments. Namely, the same advantage may also be obtained from a liquid ejection head in which the upper electrode is used as the common electrode and the lower electrode is used as the individual electrode.

What is claimed is:

1. A liquid ejection head comprising:

a plurality of structures arrayed in a predetermined direction, each structure including a nozzle to eject liquid, a pressure chamber in communication with the nozzle, and an ejection drive unit to increase pressure of the liquid in the pressure chamber, wherein the ejection drive unit of each structure includes a diaphragm to form a wall of the pressure chamber, and an electromechanical transducer element including an electromechanical transducer film, the diaphragm being convex toward the pressure chamber, and wherein, when an amount of curvature of the diaphragm for the pressure chamber of each structure is defined by a radius of curvature, an inclination difference of the radius of curvature with respect to the predetermined direction is equal to or less than 2500 μm, and wherein, when an approximated straight line is drawn for a distribution of radii of curvature of the diaphragm for a remainder of the plurality of structures after 20 structures from each of the right and left ends of the plurality of structures in the predetermined direction are excluded, the inclination difference of the radius of curvature with respect to the predetermined direction corresponds to a difference between a radius of curvature of the diaphragm at a left end of the approximated straight line and a radius of curvature of the diaphragm at a right end of the approximated straight line.

2. The liquid ejection head according to claim 1, wherein for the pressure chambers of the plurality of structures arrayed in the predetermined direction, an average value of the radii of curvature of the diaphragm is in a range between 2000 μm and 5000 μm.

3. The liquid ejection head according to claim 1, wherein the electromechanical transducer film for each structure contains lead zirconate titanate (PZT) and a composition ratio Ti/(Zr+Ti) with respect to Zr and Ti contained in the electromechanical transducer film is in a range between 0.45 and 0.55.

4. The liquid ejection head according to claim 1, wherein the diaphragm for the pressure chamber of each structure includes a silicon oxide layer, a silicon nitride film, and a plurality of polysilicon layers, and the diaphragm has a film thickness in a range between 1 μm and 3 μm.

5. The liquid ejection head according to claim 1, wherein the diaphragm for the pressure chamber of each structure is formed to have a Young's modulus in a range between 75 GPa and 95 GPa.

6. The liquid ejection head according to claim 1, wherein the pressure chamber of each structure is formed to have a width in a lateral direction in a range between 50 μm and 70 μm.

7. The liquid ejection head according to claim 1, wherein a ratio of (film thickness(max)−film thickness(min))/(film thickness(max)+film thickness(min)) with respect to film thicknesses of the electromechanical transducer films for the pressure chambers of the structures is equal to or less than 5%.

8. A liquid ejection device comprising:

the liquid ejection head according to claim 1; and at least one of a head tank which stores the liquid supplied to the liquid ejection head, a carriage on which the liquid ejection head is mounted, a supply mechanism which supplies the liquid to the liquid ejection head, a maintenance recovery mechanism which performs maintenance and recovery for the liquid ejection head, and a scanning movement mechanism which moves the liquid ejection head in a main scanning direction, is incorporated in the liquid ejection unit with the liquid ejection head.

9. A liquid ejection head comprising:

a plurality of structures arrayed in a predetermined direction, each structure including a nozzle to eject liquid, a pressure chamber in communication with the nozzle, and an ejection drive unit to increase pressure of the liquid in the pressure chamber, wherein the ejection drive unit of each structure includes a diaphragm to form a wall of the pressure chamber, and an electromechanical transducer element including an electromechanical transducer film, the diaphragm being convex toward the pressure chamber, wherein, when an amount of curvature of the diaphragm for the pressure chamber of each structure is defined by a radius of curvature, an inclination difference of the radius of curvature with respect to the predetermined direction is equal to or less than 2500 μm, and wherein, when a hysteresis loop is measured by applying electric-field intensities of ±150 kV/cm to the electromechanical transducer film for each structure, a polarizability indicated by a value of (Pr−Pind) where Pind denotes an initial polarization at 0 kV/cm and Pr denotes a polarization at 0 kV/cm when the electric-field intensity is returned to 0 kV/cm after the electric-field intensity of +150 kV/cm is applied is equal to or less than 10 $\mu C/cm^2$.

10. The liquid ejection head according to claim 9, wherein a ratio of (film thickness (max)−film thickness(min))/(film thickness(max)+film thickness(min)) with respect to film thicknesses of the electromechanical transducer films for the pressure chambers of the structures is equal to or less than 5%.

11. The liquid ejection head according to claim 9, wherein, when displacement characteristics δ of the electromechanical transducer film for each structure are evaluated by applying an electric-field intensity of 150 kV/cm to the electromechanical transducer film, a ratio Δδ/δ_ave is equal to or less than 8% where Δδ denotes an inclination difference of the displacement characteristics δ with respect to the predetermined direction, and δ_ave denotes an average value of displacement characteristics δ.

12. A liquid ejection head comprising:

a plurality of structures arrayed in a predetermined direction, each structure including a nozzle to eject liquid, a pressure chamber in communication with the nozzle, and an ejection drive unit to increase pressure of the liquid in the pressure chamber, wherein the ejection drive unit of each structure includes a diaphragm to form a wall of the pressure chamber, and an electromechanical transducer element including an electromechanical transducer film, the diaphragm being convex toward the pressure chamber, wherein, when an amount of curvature of the diaphragm for the pressure chamber of each structure is defined by a radius of curvature, an inclination difference of the radius of curvature with respect to the predetermined direction is equal to or less than 2500 μm, and wherein, when displacement characteristics δ of the electromechanical transducer film for each structure are evaluated by applying an electric-field intensity of 150 kV/cm to the electromechanical transducer film, a ratio Δδ/δ_ave is equal to or less than 8% where Δδ denotes an inclination difference of the displacement characteristics δ with respect to the predetermined direction, and δ_ave denotes an average value of displacement characteristics δ.

* * * * *